US006463226B2

(12) United States Patent
Kitajima et al.

(10) Patent No.: US 6,463,226 B2
(45) Date of Patent: Oct. 8, 2002

(54) IMAGE FORMING APPARATUS WHICH CORRECTS IMAGE FORMING CONDITIONS IN LOW-TEMPERATURE ENVIRONMENT AND AT CONTINUOUS IMAGE FORMATION

(75) Inventors: Kenichiro Kitajima, Mishima; Yuichiro Toyohara, Fujisawa, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/818,737

(22) Filed: Mar. 28, 2001

(65) Prior Publication Data

US 2001/0043815 A1 Nov. 22, 2001

(30) Foreign Application Priority Data

Mar. 29, 2000 (JP) ..... 2000-092085
Mar. 31, 2000 (JP) ..... 2000-096405

(51) Int. Cl.[7] ..... G03G 15/00
(52) U.S. Cl. ..... 399/44
(58) Field of Search ..... 399/94, 97, 44

(56) References Cited

U.S. PATENT DOCUMENTS 5,893,009 A * 4/1999 Yamada ..... 399/44
5,966,558 A * 10/1999 Kikui ..... 399/44
6,281,963 B1 * 8/2001 Takahata et al. ..... 399/44

FOREIGN PATENT DOCUMENTS

JP 10-28229 1/1998

* cited by examiner

*Primary Examiner*—Susan S. Y. Lee
(74) *Attorney, Agent, or Firm*—Fitzpatrick, Cella, Harper & Scinto

(57) ABSTRACT

There is herein disclosed an image forming apparatus comprising an image bearing member for bearing an electrostatic image, a developing device for developing the electrostatic image on the image bearing member, a temperature and humidity sensor for detecting temperature and humidity, a deciding device for deciding an image forming condition based on the detection output of the temperature and humidity detection sensor, and a correcting device for correcting the decision of the image forming condition by the deciding means in a low humid environment and at continuous image formation.

6 Claims, 33 Drawing Sheets

| FIG. 5A |
| --- |
| FIG. 5B |

MOISTURE AMOUNT VS ΔV1

AT 200 SHEETS CONTINUATION STATE

FIG. 17

(a)

[Sub A]
CONVENTIONAL FEEDFORWARD CONTROL
ENVIRONMENT SET
Vd, Vl, DEVELOPMENT vdc, LUT SET (b)

[Sub B]
HISTORY SHEET NUMBER N=0
CORRECTION VALUE X=0

(c)

[Sub C]
(1) CALCULATION OF CORRECTION LUT BASED ON "CORRECTION VALUE VS SHEET NUMBER N" TABLE
LUT=f (SHEET NUMBER N, MOISTURE AMOUNT)
(2) TO CONTROL DEVICE
→RETURN (d)

[Sub D]
(1) CALCULATION OF RECOVERY SHEET NUMBER S
$S=20\times\Delta t\,(sec)/60\times(COEFFICIENT\ A)$
COEFFICIENT A=5
(2) CORRECTION OF HISTORY SHEET NUMBER N
N=N−S (e)

[Sub E]
(1) STORING OF HISTORY SHEET NUMBER N
(2) DETECTION OF JOB END
$\Delta t=0$: START

FIG. 29

[Sub C]

(1) EXECUTION OF CALCULATION OF CORRECTION VALUE X BASED ON "CORRECTION VALUE VS SHEET NUMBER N" TABLE

CORRECTION VALUE X=F (SHEET NUMBER N, MOISTURE AMOUNT)

(2) SENDING OF CORRECTION VALUE X TO [Sub A]

FIG. 32

[Sub C]

(1) EXECUTION OF CALCULATION OF CORRECTION VALUE X BASED ON "CORRECTION VALUE VS SHEET NUMBER N" TABLE

CORRECTION VALUE X=F (SHEET NUMBER N, MOISTURE AMOUNT)

CHANGE AMOUNT OF $\gamma$ CORRECTION LUT=F (CORRECTION VALUE)

(2) SENDING OF CORRECTION VALUE X TO [Sub A]

IMAGE FORMING APPARATUS WHICH CORRECTS IMAGE FORMING CONDITIONS IN LOW-TEMPERATURE ENVIRONMENT AND AT CONTINUOUS IMAGE FORMATION

BACKGROUND OF THE INVENTION

1. Field of the Invention

The present invention relates to an image forming apparatus such as a copier or a printer which uses an electrophotographic system or an electrostatic recording system.

2. Related Background Art

When an image forming apparatus is used, and if an operating environment around the apparatus is different from a storage environment of paper as a recording material, or even if the operating environment is the same as the storage environment of the paper, it can be presumed that the image forming apparatus is operated in a state where a moisture amount in the atmosphere of the operating environment is different from a moisture absorption amount of the paper.

Generally speaking, when plain paper (neutral paper) used for copying or the like stands alone in each environment from a state of room temperature, the time required for allowing a sheet of paper to sufficiently adapt itself to the environment is about one hour. Even if the paper loaded in a cassette and supplied to an image forming apparatus adapts itself to the environment for a sufficiently long time, moisture is absorbed in and dehydrated from a portion near by the surface in each environment.

In the situation above, especially in a low humid environment in which an absolute moisture amount in a surrounding environment of an image forming apparatus is small, if a continuous image output or an intermittent image output within a fixed time is successively performed exceeding the fixed time (a pseudo continuous image output), the difference (moisture amount of apparatus surrounding environment<moisture amount of paper) of this moisture amount may cause trouble for the image forming process.

In case of an image forming apparatus of an electrophotographic method, although transferring means uses a transferring belt, a roller or the like as a transferring member to transfer a toner image formed on a photosensitive member to paper, this transferring member is frequently used in contact with the photosensitive member or with a fixed amount of small gap retained. The toner image on the photosensitive member is efficiently transferred to the paper by making the paper adhere to the photosensitive member in a certain amount of adhesion state with this contacting or non-contacting transferring member.

When a continuous image output including a pseudo continuous image output is performed, a latent image potential change on a photosensitive member that is considered as influences, such as exfoliation discharge at transfer, a transfer voltage and the difference in a moisture amount of paper and an image forming apparatus occurs, and an image density change occurs.

A phenomenon in which a latent image on a photosensitive member is changed due to such continuous image output is a transient change unlike a degraded change until the life of an image forming apparatus expires. Accordingly, since the phenomenon is recovered when a certain measure of time elapses, the corrective action is difficult.

Generally, as remedy means against a latent image potential change on a photosensitive member, detection of environmental data, such as temperature and humidity, detection of the potential on the photosensitive member or detection of the density on the photosensitive member, a transferring material, an intermediate transferring member or paper is performed, and the density correction of an output image is performed based on each result.

If a potential sensor and a density sensor is not mounted on an image forming apparatus, such a method is usually used that makes an estimate to the extent of a process life and performs density correction based on the detection data of environmental parameters, such as temperature and humidity, using a potential change table and a development contrast on a previously prepared photosensitive member.

Further, in case of an image forming apparatus having no potential sensor and density sensor, there is also a method for reading an image density (a gradation pattern) using external reading means, such as a scanner, concerning an output image, and making the image forming apparatus perform correction according to a gradation correction table using communication means, as a measure for a density change.

However, since the density change under continuous output is a transient decrease, it is difficult to take a sufficient measure as long as such an image forming apparatus that always detects the potential on a photosensitive member and performs feedback control is not used. Moreover, if the correction described above is made by the reading means in such a situation in which a transient potential change on the photosensitive member occurs, the correction runs into a situation in which density correction is further necessary (refer to Japanese Patent Application Laid-Open No. 10-28229).

Hence, a measure for a change of a latent image on a photosensitive member, especially a decrease of an exposure portion potential (light portion potential Vl) that is directly linked with a density change, caused by a continuous image output using paper in a low humid environment, is necessary.

FIG. 7 shows a transition of a Dmax density at the time when a continuous image output is performed in a low humid environment at a temperature of 23° C. and a humidity of 5%. This environment at the temperature of 23° C. and the humidity of 5% is a low humid environment in which a moisture amount is 0.89 g/1 kg (a unit indicates g of water/l kg of air), and the moisture amount is less than 1 g/l kg.

It is known from FIG. 7 that density decreases when a continuous image output is performed, and the density is recovered when the continuous image output stops for a certain period.

A latent image potential change in a passed sheet portion on a photosensitive member at this time is shown in FIG. 8. It is known from by FIG. 8 that density decreases due to a continuous image output, and the density is recovered when the continuous image output stops for a fixed period. It is characteristic that while the potential (Vd) of the non-exposure portion is almost fixed, a change of the potential (Vl) of the exposure portion is large.

FIG. 9 shows an enlarged drawing of the exposure portion potential of FIG. 8. It is well known from FIG. 9 that a decrease amount of the exposure portion potential VI also reaches 40 to 50 V at a maximum. It is known that the potential Vl decreases even in the exposure portion in which no image is formed on paper.

Since a change of the exposure portion potential on this level has a great effect on a development contrast potential, it causes a density change of about $\Delta D=0.1$ or more as shown in FIG. 7.

As causes of a decrease of the exposure portion potential as shown in FIG. 9, various influence factors are considered. For example, a transfer voltage, exfoliation discharge in a transfer unit, wear between a photosensitive member and paper, a sensitivity change of the photosensitive member due to a temperature change, a sensitivity change of the photosensitive member due to a moisture absorption amount of paper or the like.

Table 1 shows the result on which the difference in a change of the exposure portion potential Vl according to the presence of 200 continuation passed sheets and the presence (ON/OFF) of transfer is examined in a low humid environment at a moisture amount of 0.89 g/kg.

TABLE 1

Decrease Amount of V1 Potential at 200 Continuation Sheets in Environment at Moisture Amount of 0.89 g/kg

| | | Passed sheet | |
|---|---|---|---|
| | | Present | None |
| Transfer | ON | −30 V | −5 V |
| | OFF | −20 V | — |

Further, a change amount from an initial value of the exposure portion potential VI at the time when a continuous output of 1,000 sheets was performed with transfer ON, and a pseudo continuous output for a total of 1,000 sheets, intermittently 500 times every two sheets, was performed are shown in FIG. 10. Besides, two kinds of lots A and B of photosensitive members were prepared. The two kinds of the lots A and B were tested for the continuous output and the one kind of the lot B was tested for the pseudo continuous output.

It is known from FIG. 10 that a potential decrease of about 50 V occurs in the exposure portion potential Vl for the continuous output of 1,000 sheets. It is also known that a decrease of the exposure portion potential of the same trend also occurs in the pseudo continuous output of 1,000 sheets of two sheets intermittence. That is, when such a continuous image output is performed including a pseudo continuous output of which the output is repeated at short time intervals, it is known that a decrease of the same exposure portion potential occurs.

Table 2 lists the result on which the recursiveness of potential according to the elapsed 5 time of the exposure portion potential Vl of which the potential decreased was confirmed in the environment at a moisture amount of 0.89 g/kg.

TABLE 2

Recursiveness of V1 Potential

| Drum lot | Number of passed sheets | Decrease amount of V1 potential | After 2 minutes | After 10 minutes | After 30 minutes |
|---|---|---|---|---|---|
| Lot A | 200 | −30 V | −10 V | 0 V | |
| | 1000 | −40 V | −20 V | 0 V | |
| Lot B | 1000 | −50 V | −30 V | −10 V | 0 V |

As a result, it is known that when a decrease amount of the exposure portion potential is about 50 V at a maximum, the longest time is required until the exposure portion potential is completely recovered, but it is recovered about in ten minutes to the level where any influence can hardly be found. When the decrease amount is 50 V or less, the exposure portion potential is completely recovered in 10 minutes or less.

FIG. 11 shows the result on which the environmental dependence of a decrease amount of the Vl potential was examined. As shown in FIG. 11, as a low humid environment where a moisture amount of the environment is little is reached, a decrease amount of the exposure portion potential increases. As the environment exceeds a moisture amount of 7.6 g/kg, the decrease amount of the potential is lost.

Table 3 lists the result on which a decrease amount of the exposure portion potential Vl was examined at the time when an exposed amount is fixed against 700 V, 500 V and 300 V of the non-exposure portion potential Vd and 200 continuation sheets were passed in A4R (A4 size paper is conveyed lengthwise).

TABLE 3

Latent Image Contrast Potential and Decrease Amount of VI Potential [23° C./5%]

| Non-exposure portion potential | Drum kind | 300 V | 500 V | 700 V |
|---|---|---|---|---|
| Lot A | Initial V1 | 60 | 120 | 170 |
| | Δ V1 | −5 | −20 | −30 |
| Lot B | Initial value | 120 | 165 | 210 |
| | Δ V1 | 0 | −10 | −20 |

It was known from the result of Table 3 that as a latent image contrast potential becomes high, a decrease amount of the Vl potential increases. The paper used is an SK 65 g sheet.

Table 4 lists the result on which a decrease amount of the exposure portion potential Vl was examined by changing the kind of the recording material to which paper passes.

TABLE 4

Various Materials and Decrease Amount of Potential (23° C./5% environment, A4R 200 continuation sheets, Vd = 670 V setting, drum lot A)

| Kind of material | Decrease amount of V1 potential |
|---|---|
| SK 65 g sheet | −30 V |
| CLC 80 g sheet | −30 V |
| CLC 105 g sheet | −30 V |
| OHT | 0 V |
| No passed sheet | −5 V |

It was known that only when paper is used as a recording material, the exposure portion potential Vl decreases, and a decrease amount of the potential differs quite little even if the thickness and kind of the paper are changed. Further, it was confirmed that the potential will not decrease even in the condition free of a passed sheet of the recording material.

It was known from the result described above that a decrease amount of the exposure portion potential is largest when paper is passed as a recording material and transfer is in the on state.

Further, it was known that a decrease amount of the exposure portion potential changes according to a moisture amount of the apparatus surrounding environment, and not only in the state of a continuation passed sheet but also in the state of an intermittence passed sheet that can be regarded as the continuation passed sheet, that is, in the state of a pseudo continuation passed sheet, the potential decreases in accordance with the number of passed sheets and the decrease amount tends to be saturated in about 1,000 passed sheets.

Concerning causes of a decrease of the exposure portion potential, as described previously, a plurality of diversified factors are assumed to be affected. However, the occurrence is limited to the case where paper was used as a recording material in a low humid environment, and it is clear that the trend in the decrease of the potential is also proportional to the number of passed sheets.

SUMMARY OF THE INVENTION

An object of the present invention is to provide an image forming apparatus that can obtain a fixed density in a low humid environment.

Another object of the present invention is to provide an image forming apparatus that prevents a density change at the time when a continuous output is performed using paper as a recording medium.

A further object of the present invention is to provide an image forming apparatus, comprising:

- an image bearing member for bearing an electrostatic image;
- developing means for developing the electrostatic image on said image bearing member;
- temperature and humidity detecting means for detecting temperature and humidity;
- deciding means for deciding an image forming condition based on the detection output of said temperature and humidity detection means; and
- correcting means for correcting the decision of the image forming condition by said deciding means in a low humid environment and at continuous image formation.

An even further object of the present invention will become clear in the following description.

BRIEF DESCRIPTION OF THE DRAWINGS

FIG. 17 is a diagram showing a control sequence in the flowchart of FIG. 16;

FIG. 29 is a diagram showing a correction sequence of a latent image contrast potential or a development contrast potential according to Embodiment 5 of the present invention;

FIG. 32 is a diagram showing a correction sequence of an LUT at the time when the latent image contrast potential and the development contrast potential were performed according to Embodiment 5 of the present invention.

DETAILED DESCRIPTION OF THE PREFERRED EMBODIMENTS

The embodiments according to the present invention are further described in detail with reference to the drawings.

(Embodiment 1)

Figure 1:
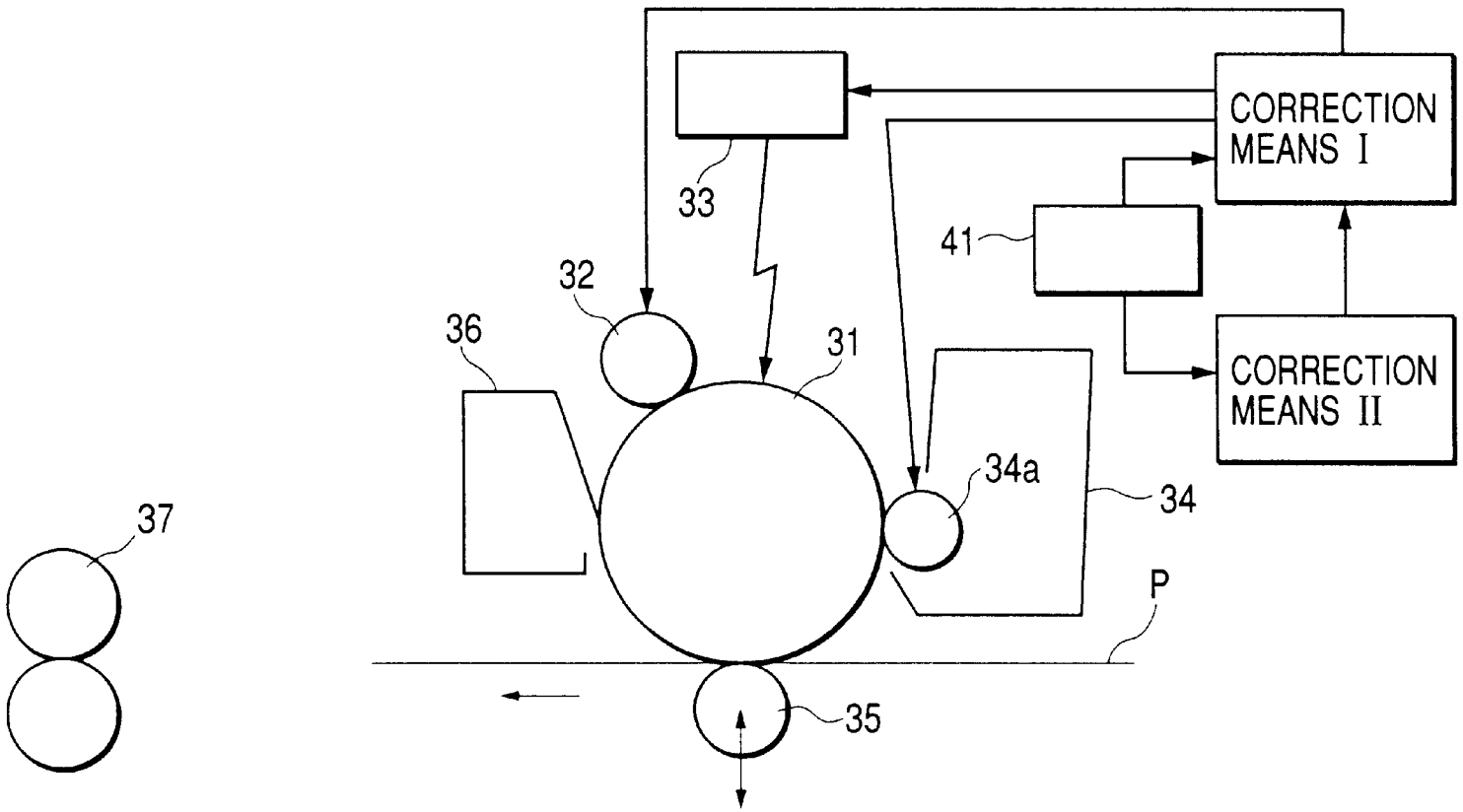
FIG. 1 is a schematic configuration diagram showing one embodiment of an image forming apparatus of the present invention.

FIG. 1 is a schematic diagram showing one embodiment of an image forming apparatus of the present invention.

This image forming apparatus has, for example, a drum type electrophotographic photosensitive member, that is, a photosensitive drum 31 as an image bearing member and evenly charges the surface of the photosensitive drum 1 into a predetermined potential by an electrifier 32 to which a charging bias was applied. Then the image forming apparatus performs image exposure by an exposing apparatus 33, such as laser, and forms an electrostatic latent image on the photosensitive drum 1. Subsequently, the image forming apparatus uses a developer (toner or toner+carrier) to develop a latent image by a developing device 34 while a development bias applies to a developing sleeve 34*a* and visualizes the latent image as a toner image.

A toner image formed on the photosensitive drum 1 is transferred by a transfer electrifier 35 to a recording material P conveyed from a recording material cassette to the photosensitive drum 31 and the recording material P to which the toner image was transferred is conveyed from the photosensitive drum 31 to a fixing apparatus 37. Then the toner image is fixed by heating and pressurization and a permanent image is obtained in the recording material P.

Well, in the present invention, an image forming apparatus comprises correction means I and correction means II, and also comprises an environmental sensor 41, time measuring means (a timer) 46, a sheet number counter 47 or the like. Then, the correction means I corrects and controls a development process condition in accordance with a situation of a surrounding environment, and the correction means II obtains a correction value against a decrease of the exposure portion potential of a photosensitive member that will occur only when a continuous image output is performed in a low humidity environment in which paper is used as the recording material P, and then the correction value is fed back to the correction means I, thereby effectively performing the control of a development contrast according to the correction of a development process condition and enabling acquisition of an image free of a density change at the time when a continuous image output including a pseudo continuous image output is performed at a low humid environment.

Figure 2:
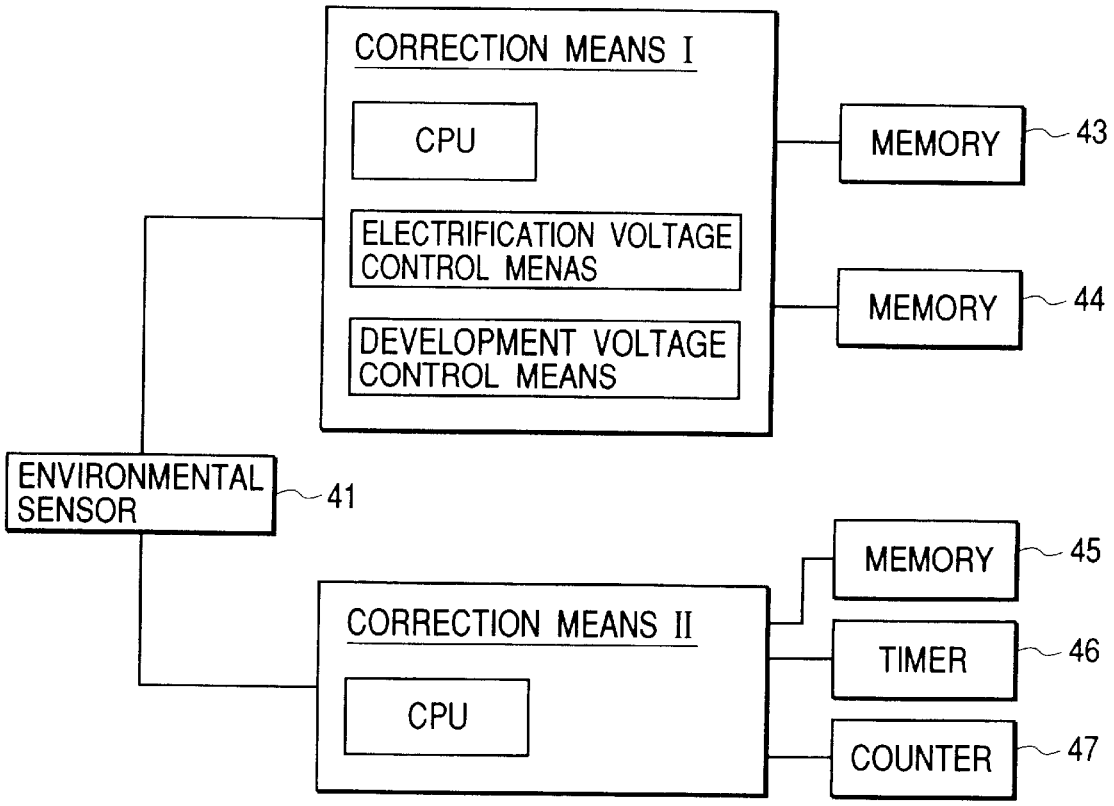
FIG. 2 is a block diagram showing correction means I and II installed in the image forming apparatus of FIG. 1.

The correction means I, as shown in FIG. 2, comprises a CPU, electrification voltage control means, development voltage control means and two memories 43, 44 that stores an environmental change table. The correction means II comprises a CPU and a memory 45 that stores a relational table of the output number of sheets and a development contrast correction value. Besides, the correction means I, II can also use the same CUP.

Figure 3:
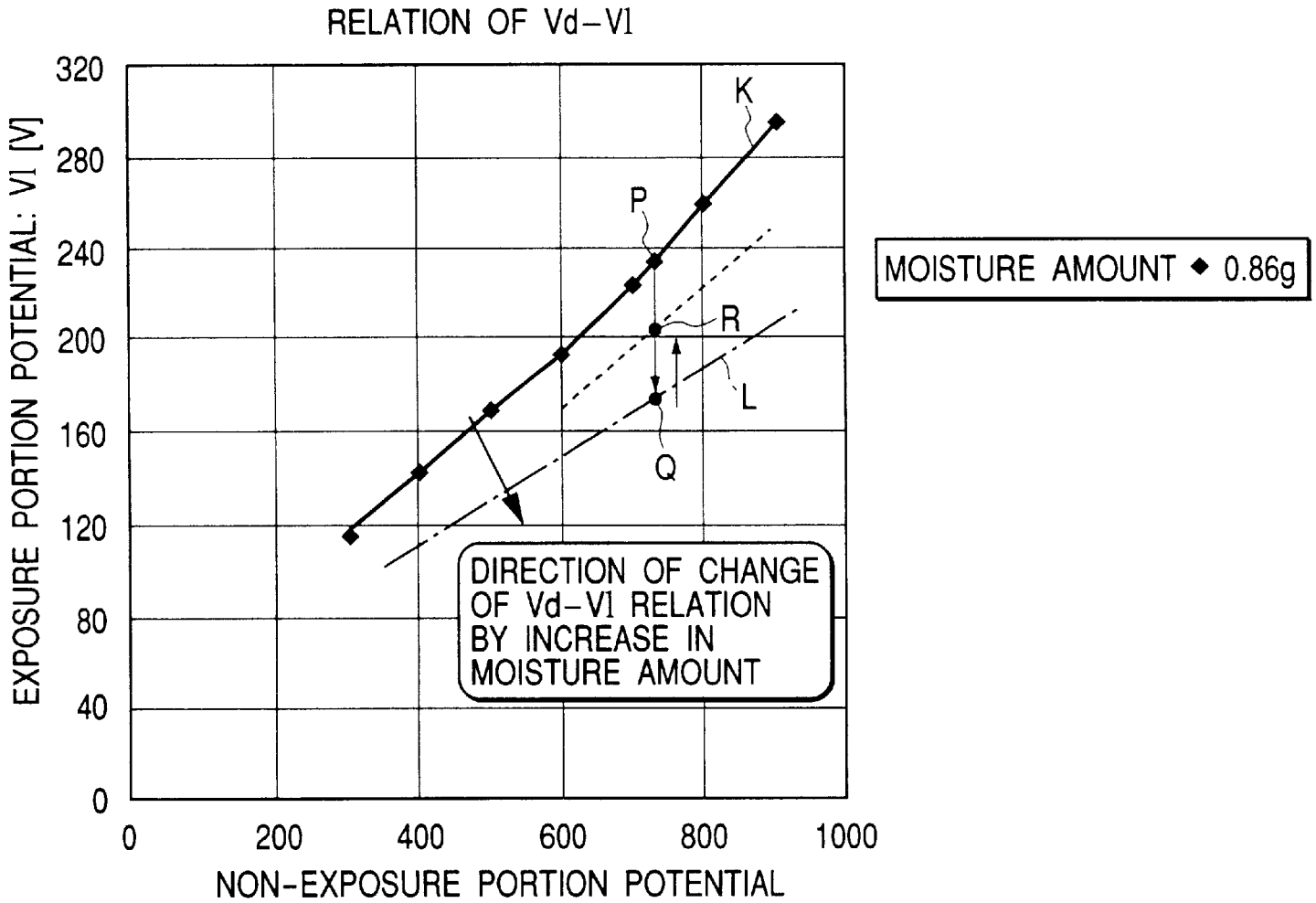
FIG. 3 is an explanatory drawing showing the relation between a non-exposure portion potential and an exposure portion potential in a low humid environment.

The content of correction control of a development process condition by the correction means I is to change a set value of the development contrast potential in accordance with environment, since a toner electrification amount Q/M used for development and a transferring parameter, such as a transfer voltage, change due to an influence of the environment (The change of a relational curve between the exposure portion potential Vl and the non-exposure portion potential Vd at the time when a moisture amount increased is the direction of the bold arrow shown in FIG. 3, for example).

A necessary development contrast potential (development Vcont) in each environment is stored in a memory 13 in a tabulized state, and, in the correction means I, the necessary development Vcont for the moisture amount obtained above is calculated. A necessary latent image contrast potential (latent image Vcont) is also calculated. The necessary latent image contrast potential Vcont is a value in which a necessary back potential (Vback) is added to the necessary development Vcont as a countermeasure to a skin fog.

$$\text{Latent image } Vcont = \text{development } Vcont + Vback$$

Next, to obtain the latent image Vcont obtained above in the photosensitive drum 1 by electrification and exposure, an environmental table in which the relation between the surface potential (non-exposure portion potential Vd) and the exposure portion potential (Vl) in each environment of a photosensitive member previously stored in the memory 44 was tabulized is used to calculate the Vd and Vl by the correction means I.

A value in which this calculated Vl and the development Vcont obtained above were added becomes potential (a development voltage Vdc (a direct current component of a development bias)) applied to the developing sleeve 34*a* of the developing device 34.

$$\text{Development voltage } Vdc = Vl + \text{development } Vcont$$

The setting of the development voltage Vdc by this correction means I is executed every time an image output (JOB) is instructed. However, if an output is performed in environment other than a low humid environment, this setting value Vdc is not changed but is retained to a value in the environment.

Next, the correction control by the correction means II is described. The control by the correction means II is executed while a continuous output is being performed.

FIG. 3 is a graph showing the relation between a non-exposure portion potential and an exposure portion potential in a low humid environment using a model. For example, when a continuous output of 1,000 sheets is performed, the exposure portion potential Vl greatly decreases from a point P, for example, on a solid line K to a point Q on a dotted line L in the diagram. A development contrast changes (increases) to the extent of the difference of the exposure portion potential at these points P and Q.

An important point of the present invention is to perform such control that keeps a development contrast potential constant by feeding back information about a change of the development contrast in accordance with a decrease of this exposure portion potential from the correction means II to the correction means I and applying correction to the electrification voltage control means and the development voltage control means of the correction means I.

Further speaking, feedback correction to the correction means I is executed when a continuous image output is performed every predetermined number of sheets (for example, 50 sheets fixed or number of sheets in which the fixed number of sheets was added by stages). Accordingly, the counter 47 counts the number of passed sheets (history number of sheets) N after execution every execution of the correction means II.

Figure 4:
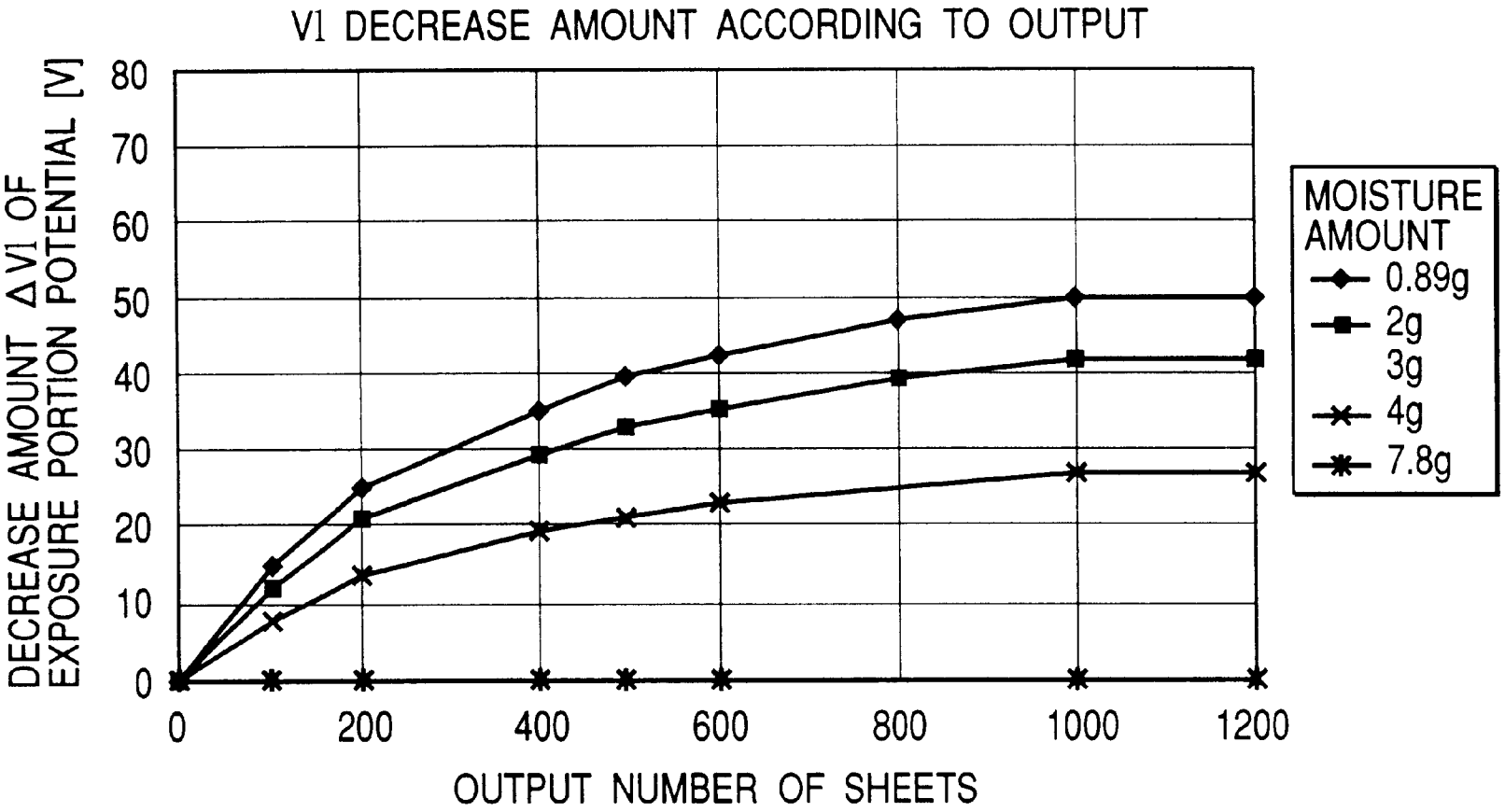
FIG. 4 is an explanatory drawing showing the relation between a continuation passed sheet and a decrease amount of an exposure portion potential.

FIG. 4 is a diagram in which the relation between the continuation number of passed sheets and a decrease amount of the exposure portion potential in a low humid environment is experimentally obtained in a plurality of low humid environments at a moisture amount of 7.6 g per kg or less.

The correction means II tabulizes this relation between the continuation output number of sheets and a decrease amount of the exposure portion potential in each low humid environment and stores it in a memory 15 to perform feedback correction to the correction means I. Further, even in a low humid environment at a moisture amount of 7.6 g per kg or less, a table of which the correction value level differs in three ranks, such as moisture amounts of 1 g/kg, 1 to 2.9 g/kg and 2.9 to 7.6 g/kg, every environment is prepared.

The correction means II uses this control table to decide a correction value X that corrects a decrease amount Δ Vl of the exposure portion potential in accordance with the output number of sheets and controls to keep a development contrast constant by correcting the correction value X to the correction means I.

The correction value X is proper correction value data for the correction means I, and, in this embodiment, the correction value data of the electrification voltage control means and the development voltage control means for the correction means I.

In the present invention, the concept of continuation of an image output includes such a case that a continuous state artificially continues even if the continuation is meant by an intermittent operation. This is since there is an example in which the exposure portion potential decreased even for the two-sheet intermittence in the result of an experiment of FIG. 10, and, the situation in which an image forming apparatus operates as a plurality of intermittent operations in an actual operating state is fully estimated.

Therefore, whether the preceding JOB (image output) and the next JOB are a continuous image output including a pseudo continuous output needs to be judged. In the present invention, specifically, a JOB (image output) terminates and a timer 16 is operated after drive stops and then an elapsed time until the next JOB is started (time after stop) Δt (sec) is measured. When Δt is within 30 seconds (Δt≦30 seconds), the subsequent JOB is defined and judged as the continuous image output for the preceding JOB, regardless of as to whether it is the pseudo continuous image output. Coefficients and values used in this definition may be changed according to a production speed and a process condition of an image forming apparatus.

The control according to the present invention is described below with reference to the flowcharts of FIGS. 5A and 5B.

Figures 5, 5A:
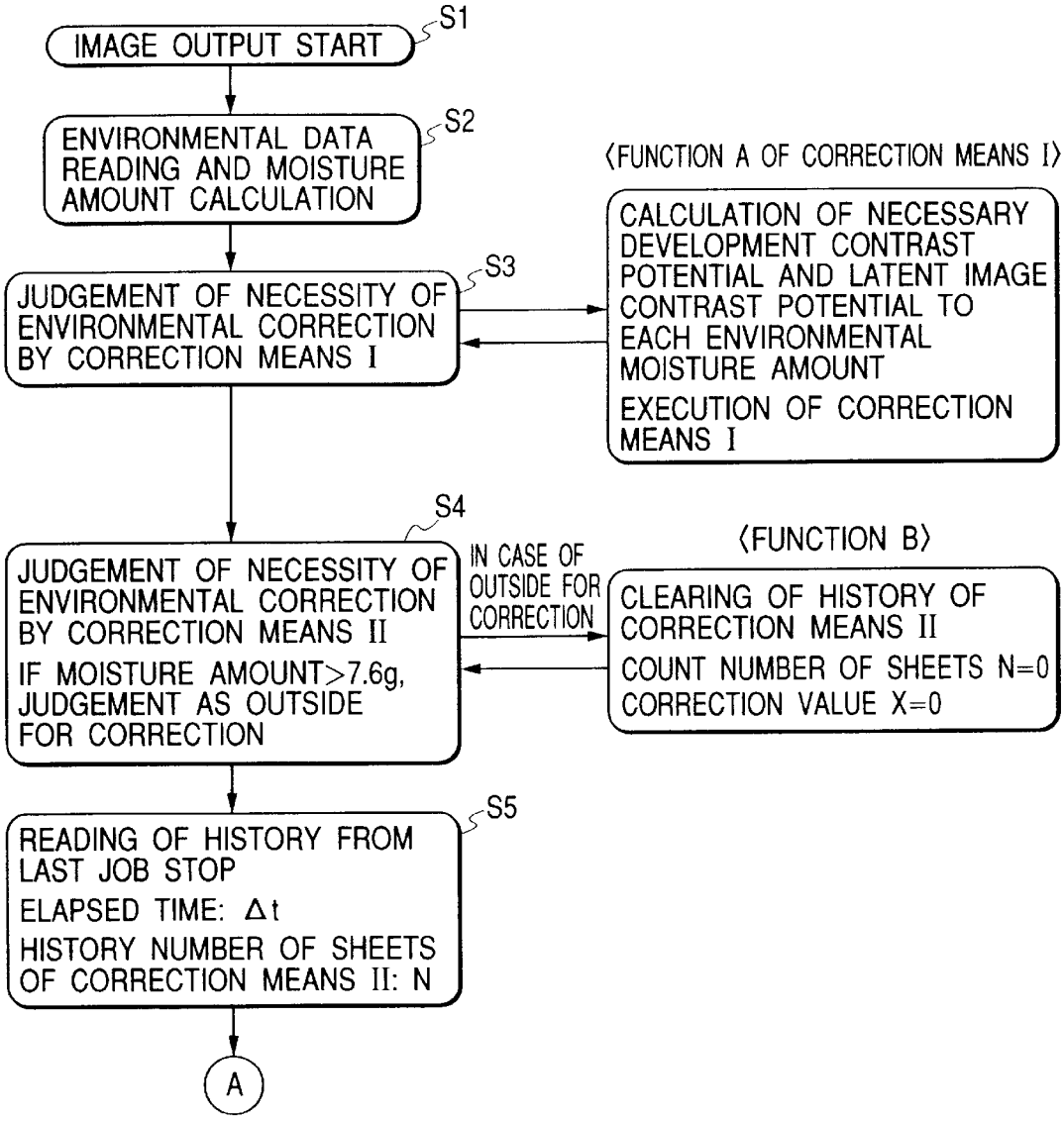
FIG. 5 is comprised of FIGS. 5A and 5B showing flowcharts illustrating control according to the present invention.
Figure 5B:
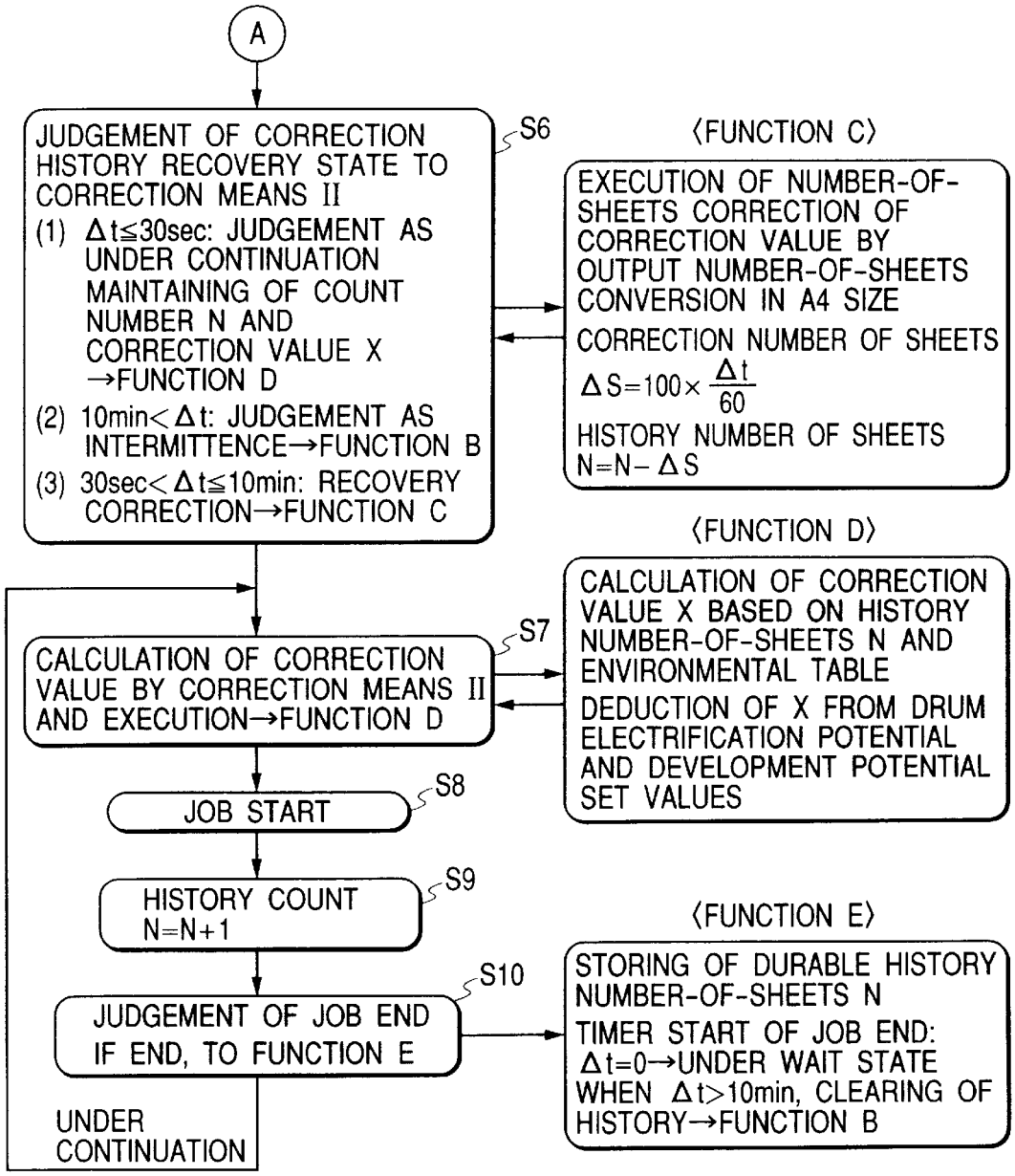

In FIGS. 5A and 5B, when an output instruction is issued to an image forming apparatus in step S1, first in step S2, the ambient temperature and humidity of the image forming apparatus are measured by an environmental sensor 11, and these environmental data are read in the correction means I, then a moisture amount of the environment is calculated.

To obtain a proper image density Dmax value, in step S3, the correction means I judges the necessity of environmental correction against the moisture amount measured in this manner. When the environmental correction is judged necessary by the correction means I, the correction means I performs correction control in the control procedure shown in a function A.

Next, in step S4, the correction means II judges the necessity of environmental correction. When the environmental correction is judged unnecessary by the correction means II (in case of a moisture amount of environment>7.6 g/kg), the history number of sheets of the correction means II is cleared in accordance with a function B. That is, the history number of sheets of the correction means II (count number of sheets by the timer 16) is set to N=0 and a correction value is set to X=0 without performing feedback from the correction means II to the correction means I.

In step S4 above, when the environmental correction is judged necessary by the correction means II (in case of a moisture amount of environment≦7.6 g/kg), in step S5, a history from the stop of the preceding JOB (image output), that is, an elapsed time Δt from the JOB stop and the history number of sheets N of the correction means II are read. In step S6, a correction history recovery state is judged, and processing is performed like (1), (2) or (3) described below in accordance with whether an image output is a continuous output including a pseudo continuous output.

(1) When Δt is within 30 seconds:

When the final one JOB before the next JOB terminates and the next JOB is started within Δt≦30 sec after drive stops, the next job is judged as a continuous output as described above. At this time, the count of the number of sheets (history number of sheets) N from the preceding correction is continuously performed by the correction means II. When the correction is continuously performed and the predetermined number of sheets is reached, in step S7, in accordance with a function D, the calculation of a correction value X by the correction means II and the feedback to the correction means I of the calculated correction value X are executed.

If environment changes when the correction by the correction means II is operating, in accordance with the relational table of FIG. 4, a correction value is corrected based on the number of sheets and correction is performed by feed backing it from the correction means II.

(2) When Δt is ten minutes or more:

When the final one JOB before the next JOB terminates and At exceeds ten minutes after drive stops (10 min<Δt), the next JOB is judged discontinuous to the preceding JOB. At this time, the correction by the correction means II is released and, in accordance with the function B, the history number of sheets that the correction means II is counting is also cleared. Then a correction release state is set (X=0), and a development contrast potential that the correction means I decided that is environmental control is recovered.

Ten minutes were decided here since a decreased state of the exposure portion potential is almost recovered about ten minutes according to the result of Table 2. Besides, since it is assumed that the recovery time may differ according to the type and material of a photosensitive member, the time can arbitrarily be changed.

(3) When Δt is from 30 seconds to less than ten minutes:

If the final one JOB of the next JOB terminates and the next JOB is started when Δt is from 30 seconds or more to less than ten minutes (30 sec<Δt≦10 min) after drive stops, processing is in an intermediate state between continuation and discontinuation of (1) and (2) described above, and, in this case, after recovery correction is performed by a function C, the processing goes to step S7 or later.

Well, in case of the intermediate state above, a decrease of the exposure portion potential is recovered to the extent equivalent to Δt. Referring to FIG. 3, the exposure portion potential Vl decreased to the state of the point Q after a continuous output is performed, for example, but it is recovered to the point R during the time Δt, for example. In this case, when the number of sheets until the following correction is performed by the correction means II is counted, it needs to be counted from the state in which the number of sheets decreased to the extent of this recovery amount.

Therefore, the time Δt is converted to the number of sheets according to the function C, and recovery correction in which the number of sheets is subtracted from the history number of sheets N like N-ΔS assuming it as the recovery correction number of sheets ΔS is performed.

As the calculation method of the recovery correction number of sheets ΔS, an example in which the time Δt is converted to the number of sheets in A4 landscape size is as follows.

Figure 10:
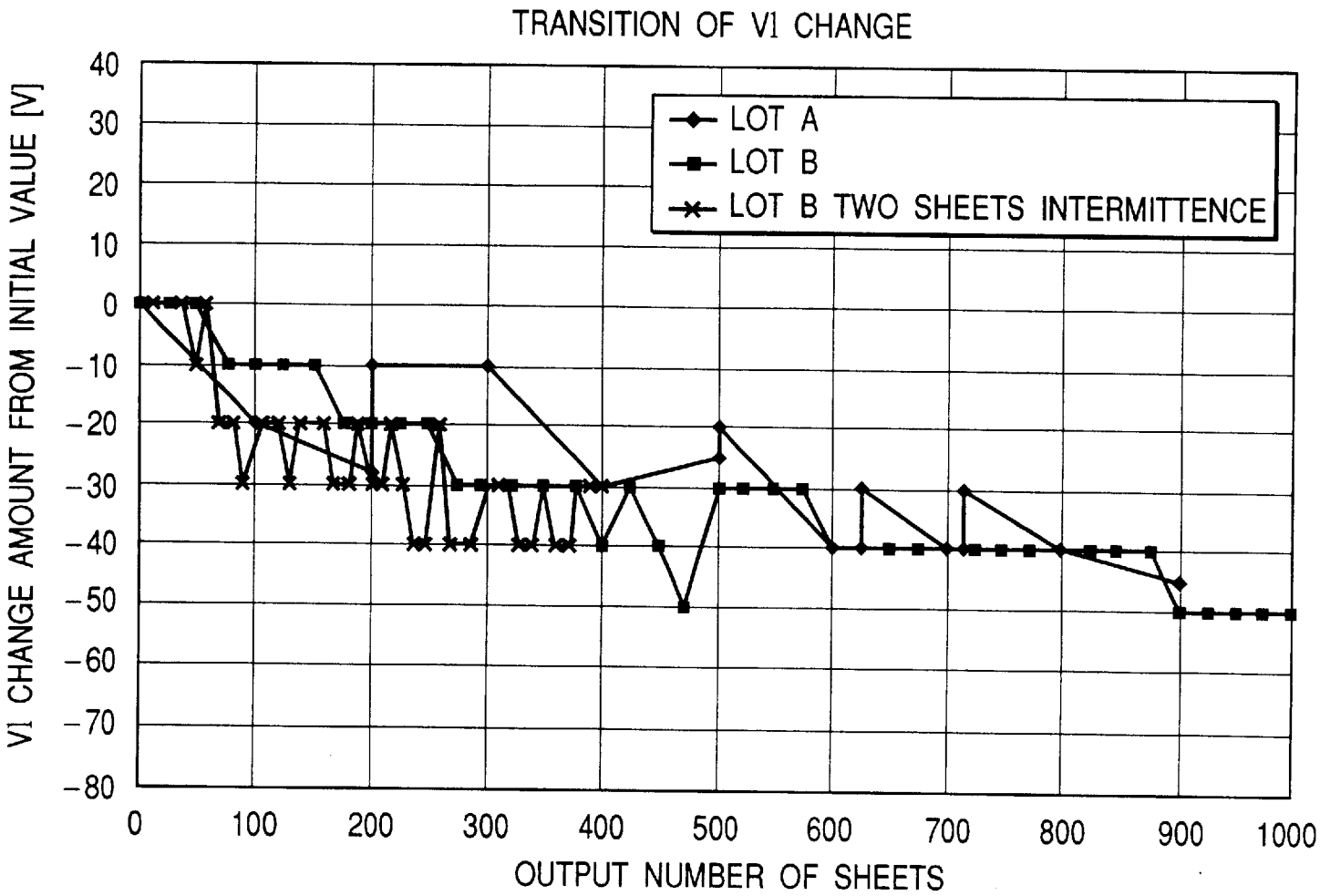
FIG. 10 is an explanatory drawing showing a change amount from an initial value of the exposure portion potential Vl at the time when a continuous output and a pseudo continuous output were performed.
Figure 11:
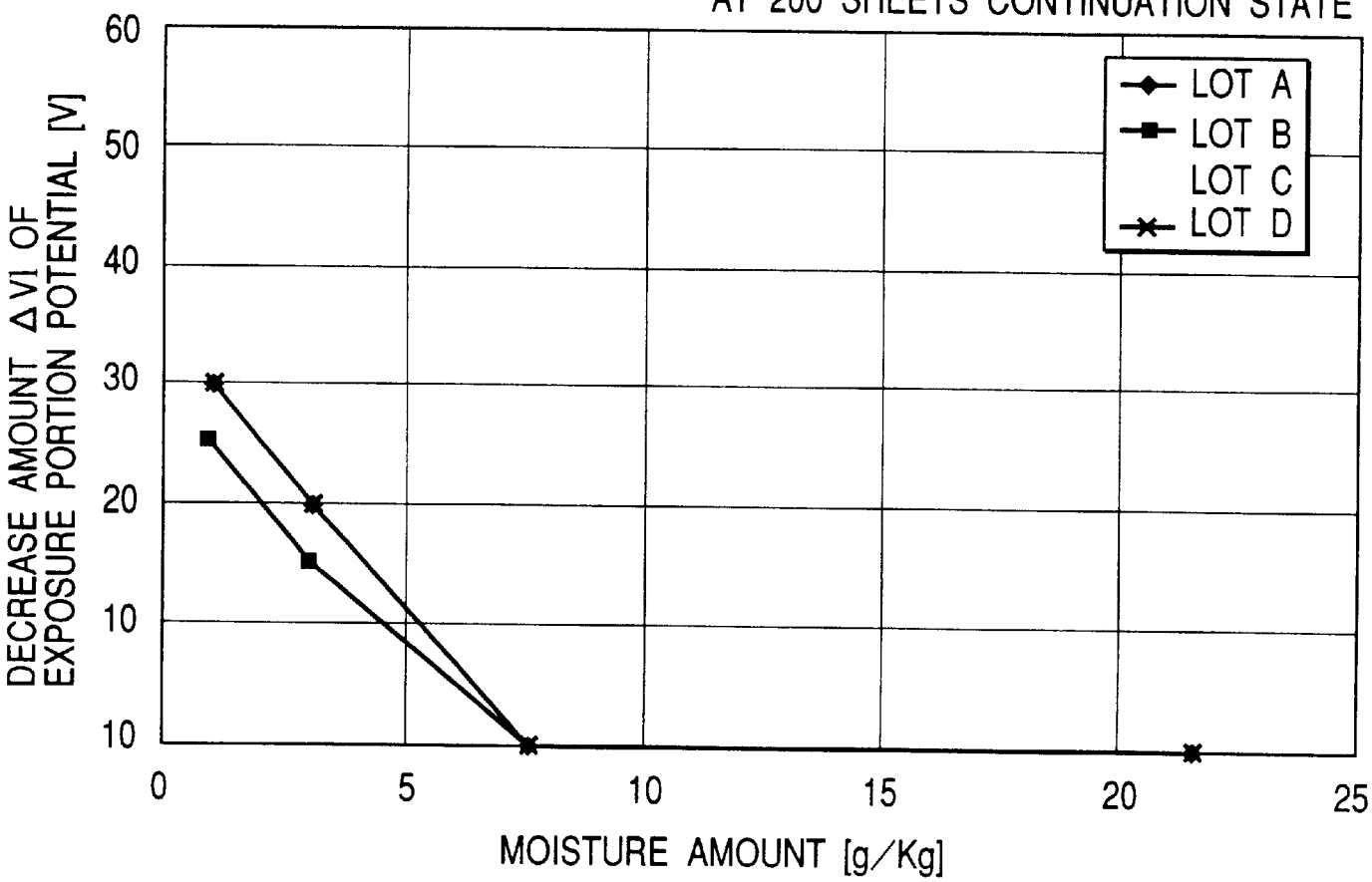
FIG. 11 is an explanatory drawing showing the result on which the environmental dependency of a decrease amount of Vl potential was examined.

Like the experimental data of FIG. 10, when the case where a decrease amount of potential almost reaches a saturated state in continuous 1,000 sheets is assumed, the following formula is obtained.

$$\text{Recovery correction number of sheets } \Delta S=\{(1{,}000(\text{sheets})/10(min)\}\times\{((\Delta t(sec)/60)\}=100\times(\Delta t/60)(\text{sheets})$$

By this method, the case of (3) described above can be corrected so that it can correspond to a complete recovery state in ten minutes of (2). Further, at this time, in a situation in which the correction history number of sheets that are the saturation potential decrease number of sheets exceeds 1,000 sheets, the recovery correction number of sheets recovers 1,000 sheets and the recovery number of sheets is counted from there. Furthermore, when N<0 as a result of the history number of sheets N=N−ΔS, a correction value 0 is set.

In step S7, by the correction means II, the calculation of a correction amount X and the feedback of the calculated correction value X to the correction means II are executed according to the function D, and in step S8, the next JOB is started.

The function D performs control in which the history number of sheets N by the counter 47 and the correction value X are obtained from the environmental table of the correction value of the memory 45 and the correction value is subtracted from the set values of the drum electrification voltage and development voltage of the function A by the correction means I.

After a JOB terminates once via step S8, as shown in step S9, 1 is added to the history count N of the counter 47, resulting in N=N+1. Then processing goes to step S10 and the termination of JOB is judged. If the processing is under continuation, the processing returns to step S7, and step S7 and later are repeated.

When a JOB terminates in step S10, in accordance with a function E, the history number of sheets N at termination is stored in the memory 45 and is cleared to the time Δt=0 of the timer 46. Then the time Δt is measured after processing starts and stops and the apparatus enters the wait state with this. Subsequently, when the time Δt>10 minutes is reached, processing goes to the function B and, as described previously, the history is cleared and the apparatus enters the wait state later.

According to the correction described above, compared with the case where the correction by the correction means II is not performed, a density change was able to decrease to nearly about half.

As described above, according to this embodiment, the correction means II judges a continuous output including a pseudo continuous output from an image output interval to a decrease of the exposure portion potential of a photosensitive member that will occur only at the continuous image output in which paper was used as a recording material in a low humid environment. Then based on the relation between the previously obtained continuous image output number of sheets and a decrease amount of the exposure portion potential, the potential decrease amount is associated with the output number of sheets and the correction values of the electrification voltage and development voltage that correspond to a development contrast change according to the potential decrease amount. Subsequently, since the control in which the results are fed back to the correction means I and the development is kept constant, an image free of a density change can be obtained by controlling to keep the development contrast constant in a good condition even at the continuous image output in which paper was used in a low humid environment.

Further, when an image output enters the intermediate state between a continuous output and an intermittent output, the part in which a decrease of the exposure portion potential was recovered is associated with the output number of sheets during the intermittence and a correction value is obtained according to the output number of sheets. At that time, since the output number of sheets is corrected to the extent in which the potential decrease amount was recovered, even if the intermediate output state occurs at continuous output, the feedback control of a development contrast can be improved.

(Embodiment 2)

In Embodiment 1, a development contrast in a continuous image output in which paper was used in a low humid environment was kept constant by applying feedback control to the correction means I by the correction means II against a decrease of the exposure portion potential of a photosensitive member in a continuous image output in which the paper was used in the low humid environment and controlling the electrification voltage of the photosensitive drum 1 by the electrifier 2 and the development voltage applied to a developing sleeve 4*a* of a developing device 4.

On the contrary, in this embodiment, to control to keep a development contrast constant in a continuous image output in which paper was used in a low humid environment, an exposure amount to the photosensitive drum 1 is controlled by the exposing apparatus 33 by performing the feedback control to the correction means I by the correction means II.

Figure 6:
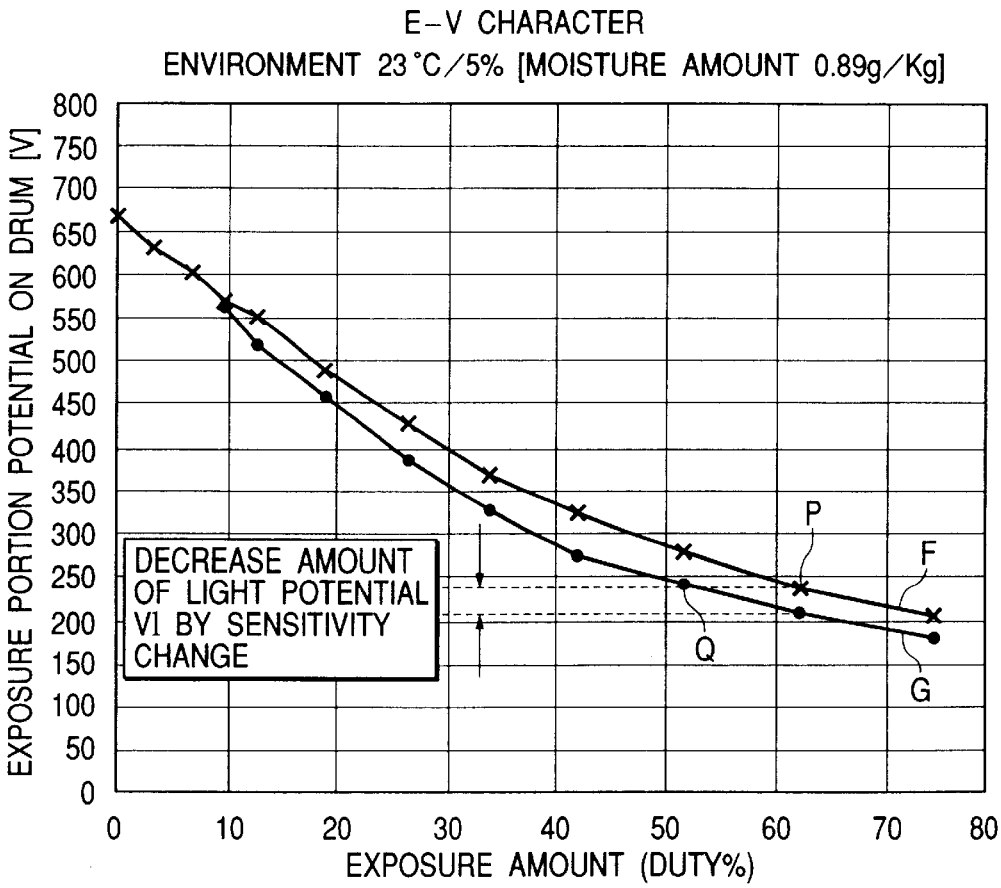
FIG. 6 is an explanatory drawing showing the relation between an exposure amount and an exposure portion potential for a continuous image output in a low humid environment.

When the exposure portion potential of a photosensitive member decreased in a continuous image output in which paper was used in a low humid environment, as shown in FIG. 6, the relation between an exposure amount and the exposure portion potential on the photosensitive member (E-V character) also changes from a curve F to G, for example.

Figure 8:
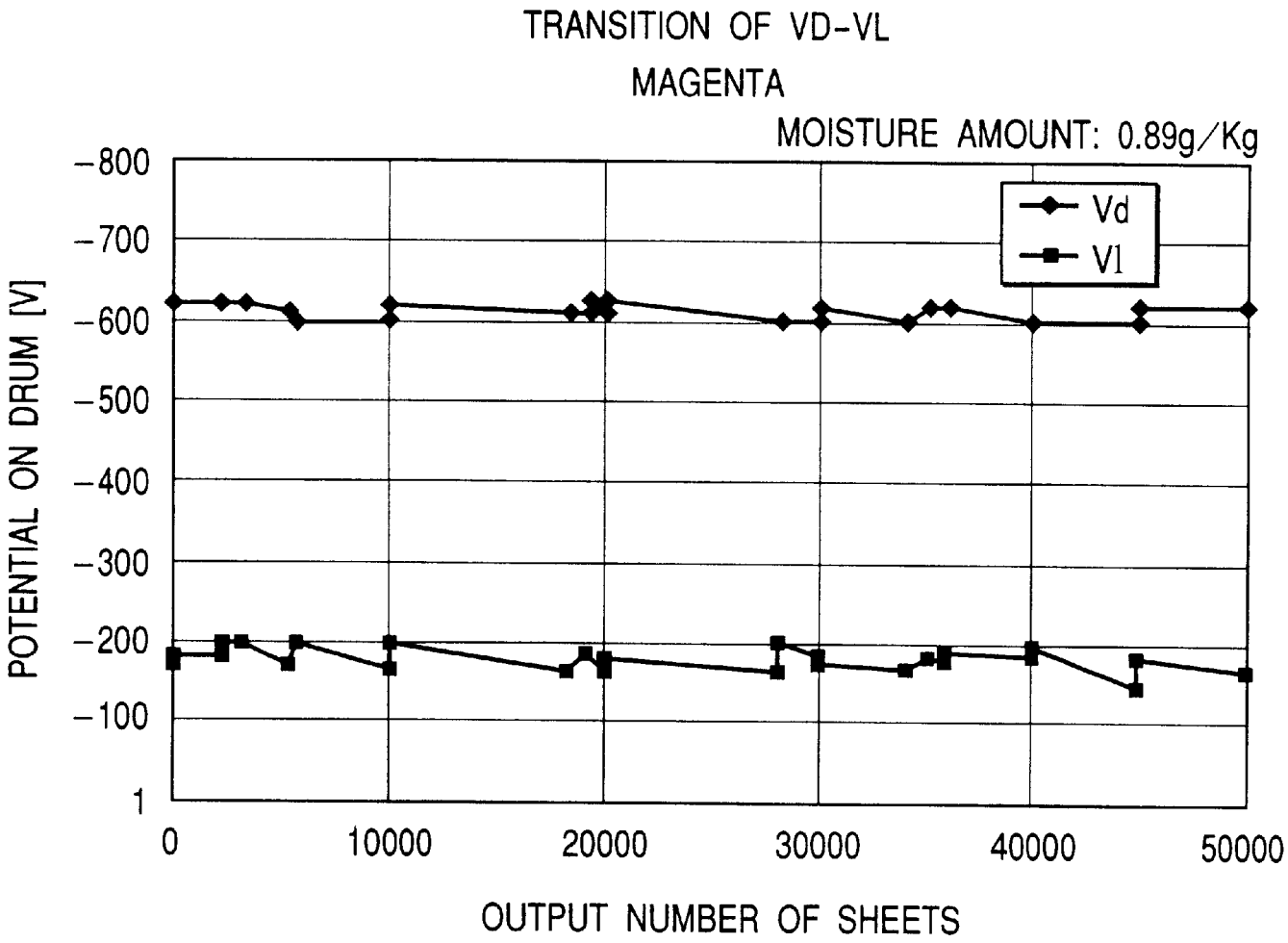
FIG. 8 is an explanatory drawing showing a latent image potential change in a passed sheet portion on a photosensitive member.
Figure 9:
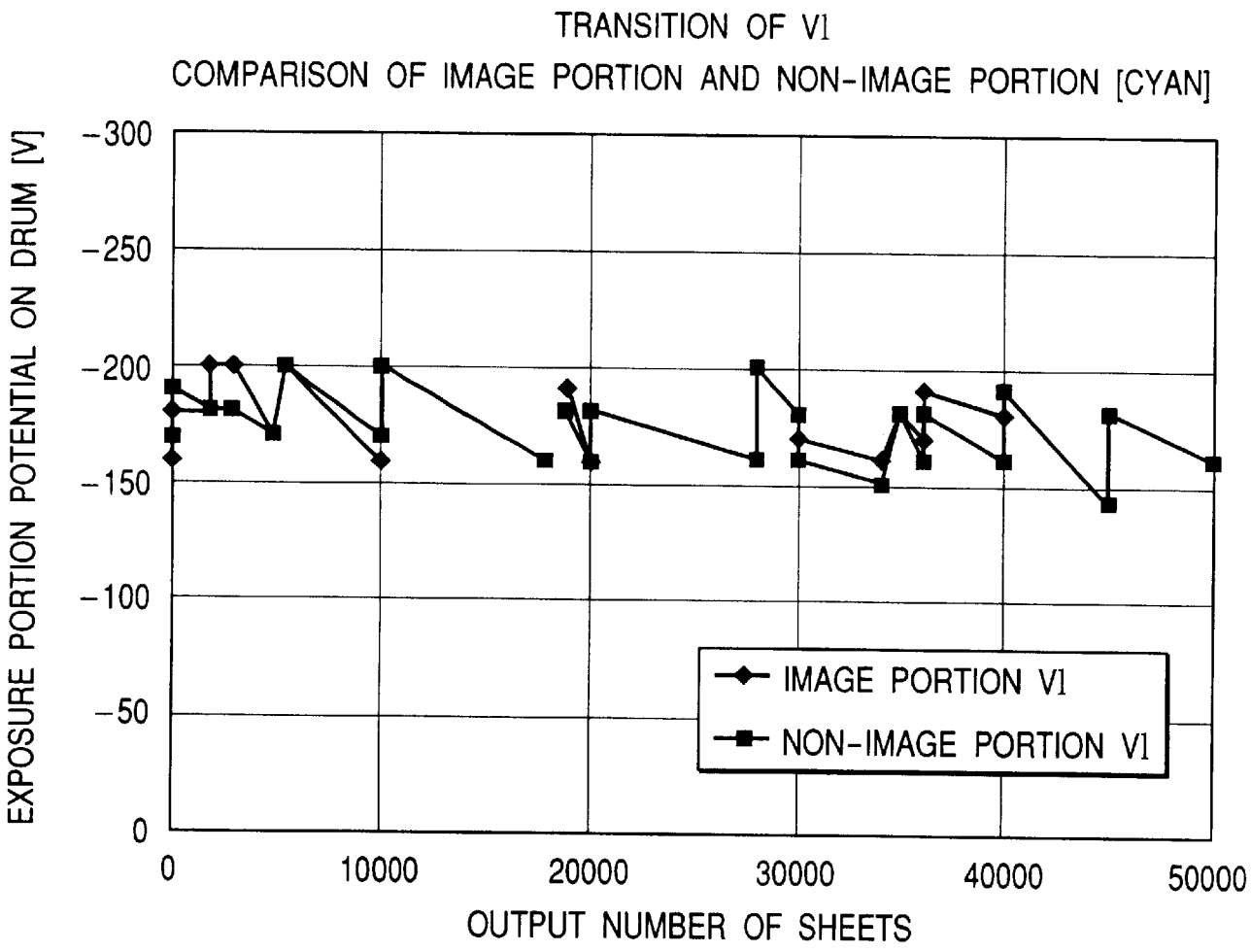
FIG. 9 is an enlarged drawing of the exposure portion potential portion of FIG. 8.

As described in FIG. 8 above, when the exposure portion potential Vl in a continuous output in a low humid environment changes, the non-exposure portion potential Vd does not change and only a decrease of the Vl occurs. Therefore, in FIG. 6, if it is assumed that the set value of the exposure portion potential (light portion potential) Vl on the curve F is the point P, an exposure amount may decrease to the point Q on the curve G to keep this Vl value constant.

Thereupon, in this embodiment, as described above, a development contrast was kept constant by applying the feedback control that controls an exposure amount to the correction means I by the correction means II in a continuous image output in which paper was used in a low humid environment.

In this embodiment, a related table tabulized by previously experimentally obtaining an E-V character to a moisture amount in a low humid environment in addition to a relational table of the same continuous image output number of sheets and exposure portion potential decrease amount as Embodiment 1 is stored in the memory 45 of the correction means II.

The correction control in this embodiment may be performed in accordance with Embodiment 1, and the correction control of the correction means I is the same as Embodiment 1. The correction control of the correction means II, based on the relation between the continuous image output number of sheets and a decrease amount of the exposure portion potential, associates the potential decrease amount with the output number of sheets and obtains a correction value of an exposure amount that corresponds to a development contrast change according to the potential decrease amount, then feeds back it to the correction means I. The correction means I controls to keep the development contrast constant by controlling exposure amount control means.

According to this embodiment, too, in the same manner as Embodiment 1, an image free of a density change can be obtained by controlling to keep a development contrast constant in a good condition.

(Embodiment 3)

This embodiment controlled a development contrast to a fixed value at a continuous image output in which paper was used in a low humid environment by obtaining a correction value of a development voltage as the correction value X by the correction means II, feeding back this to the correction means I and controlling development voltage control means by the correction means I.

According to the method of this embodiment, too, an image free of a density change can be obtained by controlling to keep a development contrast constant in a good condition.

(Embodiment 4)

Figure 12:
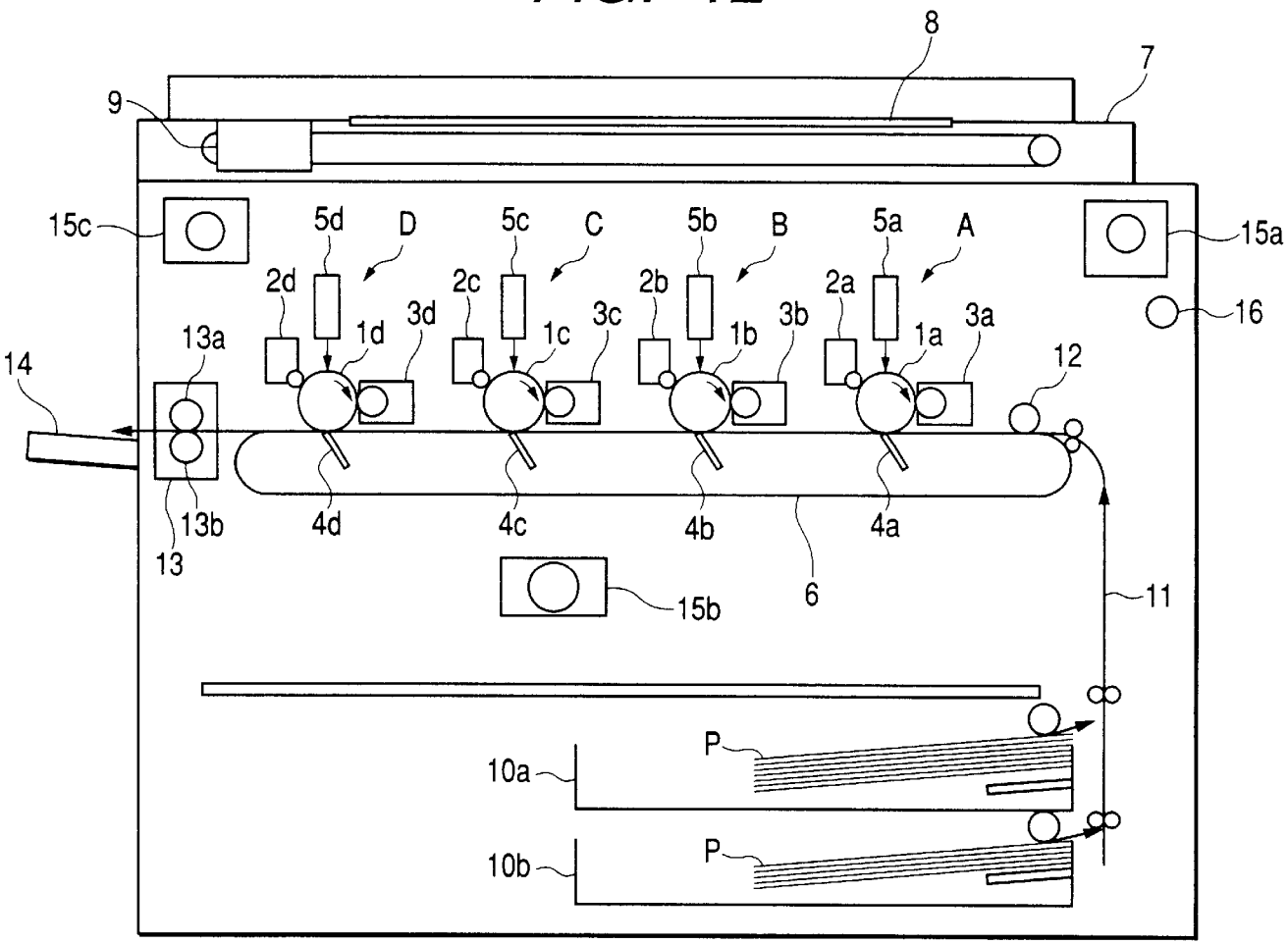
FIG. 12 is a schematic configuration diagram showing an image forming apparatus according to Embodiment 4 of the present invention.

FIG. 12 is a schematic configuration diagram showing an image forming apparatus according to an embodiment of the present invention. The image forming apparatus of this embodiment comprises an image forming apparatus every colors of yellow, magenta, cyan and black. The image forming apparatus is, what is called, a tandem type electrophotographic full-color copier that forms a color image by multiply transferring a toner image of a different color formed by each image forming apparatus on paper (a recording medium) electrostatically attracted on a transferring belt and conveyed and has a cleaner-less structure by cleaning simultaneous with developing.

This image forming apparatus comprises four image forming portions (image forming apparatuses) of an image forming portion A that forms an image of a yellow color, an image forming portion B that forms an image of a magenta color, an image forming portion C that forms an image of a cyan color and an image forming portion D that forms an image of a black color. These four image forming portions A, B, C and D comprise drum type electrophotoelectric photosensitive members (hereinafter referred to as photosensitive drums) 1*a*, 1*b*, 1*c* and 1*d* respectively.

Electrifiers 2*a*, 2*b*, 2*c*, 2*d*, developing apparatuses 3*a*, 3*b*, 3*c*, 3*d* and transferring blades 4*a*, 4*b*, 4*c*, 4*d* are arranged around the photosensitive drums 1*a*, 1*b*, 1*c*, 1*d* respectively, and exposing apparatuses 5*a*, 5*b*, 5*c*, 5*d* are installed above the charging apparatuses 2*a*, 2*b*, 2*c*, 2*d* and the developing apparatuses 3*a*, 3*b*, 3*c*, 3*d* respectively. A no-end type transferring belt 6 that electrostatically attracts and conveys the paper P as a recording medium is installed in the transferring portion between the photosensitive drums 1*a*, 1*b*, 1*c*, 1*d* and the transferring blades 4*a*, 4*b*, 4*c*, 4*d*. Further, this image forming apparatus does not comprise potential detecting means that detects the potential (exposure portion potential, non-exposure portion potential) of the photosensitive drums 1*a*, 1*b*, 1*c*, 1*d* and density detecting means that detects the density of an output image (toner image).

Next, the image forming operation by the image forming apparatus described above is described.

When an image forming operation start signal is issued, each of the photosensitive drums 1*a*, 1*b*, 1*c*, 1*d* that rotates clockwise at a predetermined process speed is evenly contacted and charged into a predetermined potential of negativity by the charging apparatuses 2*a*, 2*b*, 2*c*, 2*d* respectively. Then an original 8 loaded on an original stand 7 is exposed and scanned by an image reading sensor 9 and a color separation image signal is obtained. This image signal is processed in a video processing portion (not illustrated) and is sent to the exposing apparatuses 5*a*, 5*b*, 5*c*, 5*d* respectively.

Exposing apparatuses 5*a*, 5*b*, 5*c*, 5*d* form an electrostatic latent image by converting the input color image signal to an optical signal to an LED optical device (not illustrated) or a laser output portion (not illustrated) respectively and scanning and exposing the surface of each of the photosensitive drums 1*a*, 1*b*, 1*c*, 1*d* respectively into which the LED light or laser light that is the converted optical signal was charged.

The electrostatic latent image formed on each of the photosensitive drums 1*a*, 1*b*, 1*c*, 1*d* is developed with each color toner of yellow, magenta, cyan and black respectively and visualized as a toner image.

Then the transferring material P paper-fed from cassettes 10*a*, 10*b* is conveyed via the conveying path 11 synchronizing with the formation of the toner image of each color onto the photosensitive drums 1*a*, 1*b*, 1*c*, 1*d*. The paper P conveyed on a transferring belt 6 is electrostatically attracted on the transferring belt 6 by an attracting roller 12 to which an attraction bias was applied and conveyed so that it can make contact with the photosensitive drums 1*a*, 1*b*, 1*c*, 1*d*. Then the toner image of each color on the photosensitive drums 1*a*, 1*b*, 1*c*, 1*d* is sequentially multiply transferred on the paper P by each of the transferring blades 4*a*, 4*b*, 4*c*, 4*d* to which the transferring bias of each transferring portion was applied and a full-color image is formed.

After the transferring material P on which a full-color image was formed is separated from the transferring belt 6, it is conveyed between a fixing roller 13*a* and a pressurizing roller 13*b* of the fixing apparatus 13, heated and pressurized. After the full-color image is fixed on the transferring material P, it is ejected on a paper ejection tray 14. Further, the transferring residual toner that remains on the photosensitive drums 1*a*, 1*b*, 1*c*, 1*d* respectively after transferring is collected once in the electrifiers 2*a*, 2*b*, 2*c*, 2*d* that make contact with each of the photosensitive drums 1*a*, 1*b*, 1*c*, 1*d*. Subsequently, the toner is re-ejected on the photosensitive drums 1*a*, 1*b*, 1*c* and 1*d* respectively and collected and reused by the developing apparatuses 3*a*, 3*b*, 3*c*, 3*d* respectively.

Moreover, in an image forming apparatus, fans 15*a*, 15*b*, 15*c* that performs cooling and exhaust in this apparatus are installed. Further, in the image forming apparatus, the temperature and humidity sensor 16 that detects the temperature and humidity in this apparatus, the controller (CPU) 17 described later, an image signal control unit 18, a sheet number detecting counter 19 and a measuring apparatus 20 are installed.

Figure 13:
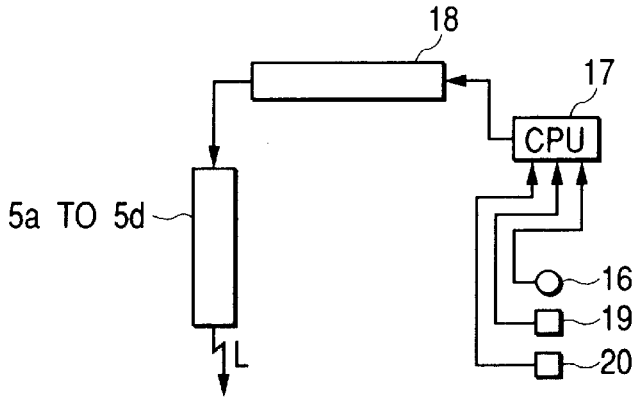
FIG. 13 is a block diagram showing a control system of an exposing apparatus for an image forming apparatus according to Embodiment 4 of the present invention.

The exposing apparatuses 5*a* to 5*d* comprise an LED light-emitting member not illustrated, an SLA (SELFOC lens) or a semiconductor laser, a collimator, a polygonal mirror and an fθ lens. The exposing apparatuses 5*a* to 5*d*, as shown in FIG. 13, output the LED light or laser light (exposure beam) L that was on/off modulated with a drive signal output from the image signal control unit 18 based on an image signal which conforms to the original 8 input to the controller (CPU) 17, to the photosensitive drums 1*a* to 1*d*.

Further, this image forming apparatus has the temperature and humidity sensor 16 that detects the temperature and humidity environment of this apparatus, the sheet number measuring counter 19 that measures the image forming number of sheets (image output number of sheets) and the measuring apparatus 20 that measures an elapsed time (image output interval) until the next image forming start after image formation (image output) is stopped. The controller (CPU) 17 calculates a γ correction value that corresponds to a density change occurring at the continuous image output in a low humid environment based on each information input from the temperature and humidity sensor 16, the sheet number detecting counter 19 and the measuring apparatus 20 respectively and changes an LUT (lookup table) (the details are described later).

Figure 14:
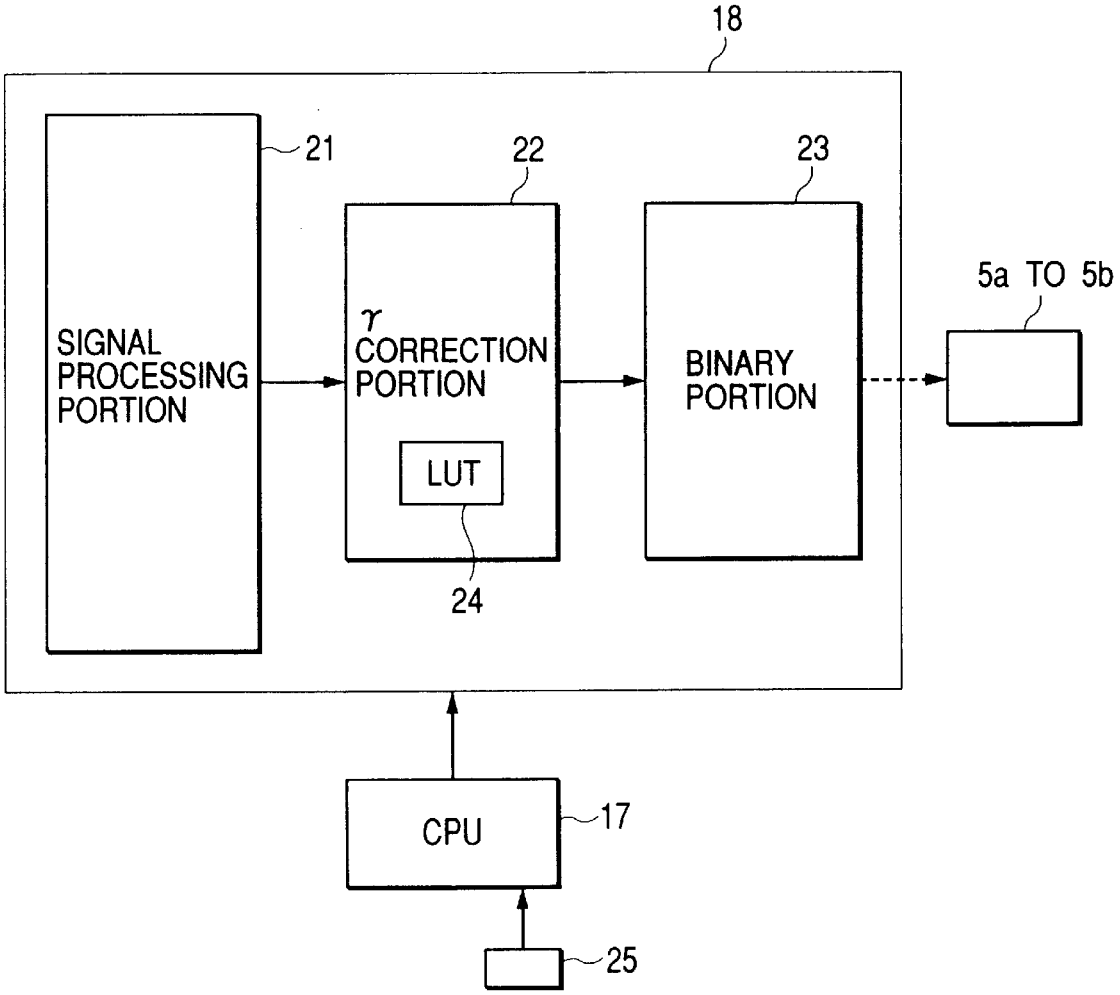
FIG. 14 is a configuration diagram showing an image signal processing portion of an image forming apparatus according to Embodiment 4 of the present invention.

The image signal control unit 18, as shown in FIG. 14, comprises a signal processing portion 21, a γ correction portion 22 and a binary portion 23, and an LUT (lookup table) 24 is installed in the γ correction portion 22. The LUT 24 is used to match the density of the original 8 and the density of an output image, and consists of a memory, such as a RAM, for example. In the image signal control unit 18, the signal processing portion 21 executes image processing that the user desires to an image signal input from the controller (CPU) 17 and the γ correction portion 22 performs γ correction to the image signal for which image processing was executed referring to the LUT 24. The binary portion 23 generates the drive signals of the exposing apparatuses 5*a* to 5*d* based on the image signal afterγ correction, and the exposing apparatuses 5*a* to 5*d* perform image exposure by irradiating the LED or semiconductor laser not illustrated based on the drive signal.

Further, a memory 25 is connected to the controller 17, and this memory 25 stores the relation between a change amount and the image output number of sheets of the image density that changes according to the change of the exposure portion potential VI of the photosensitive drums 1*a* to 1*d* that occurs during the continuous image output in a low humid environment, the relation between the value of an absolute moisture amount in the air in an image forming apparatus or an arbitrary temperature and humidity environment in its circumference, the latent image contrast potential of the photosensitive drums 1*a* to 1*d* and between the value of the absolute moisture amount and the development contrast potential and the relation between the continuous image output number of sheets and the exposure portion potential Vl of the photosensitive drums 1*a* to 1*d*.

Next, the controller (CPU) 17 in this embodiment is described.

The controller (CPU) 17, at the image formation described above, changes an electrification bias voltage and a development bias voltage or the like so that a proper image can be obtained by changing an image forming condition (the electrification voltage of the photosensitive drum 1, development bias into the developing sleeve 3*a* or the like) based on the temperature and humidity information input from the temperature and humidity sensor 16. Further, the controller (CPU) 17 performs γ correction for an image density signal value using an LUT (lookup table) of 256 gradations in 0 to 255 levels as shown in FIG. 33, and the image signal control unit 18 is controlled and can perform density correction so that the relation of density (image density) to these gradations can be linear.

Hereupon, the γ correction method above is described. For example, it is assumed that the relation between a gradation (image density signal value) and density as shown in a of FIG. 33 in an arbitrary temperature and humidity environment within the operation warranty range of an image forming apparatus and at image formation initial state. Besides, as the relation between this gradation (image density signal value) and density establishes such a linear relation as shown in b of FIG. 33, reproduction of a proper halftone density is enabled. Further, this proper halftone density can be obtained if the image density values that correspond to all gradations (256 gradations) are evenly divided when the image density D=1.3.

Figure 15:
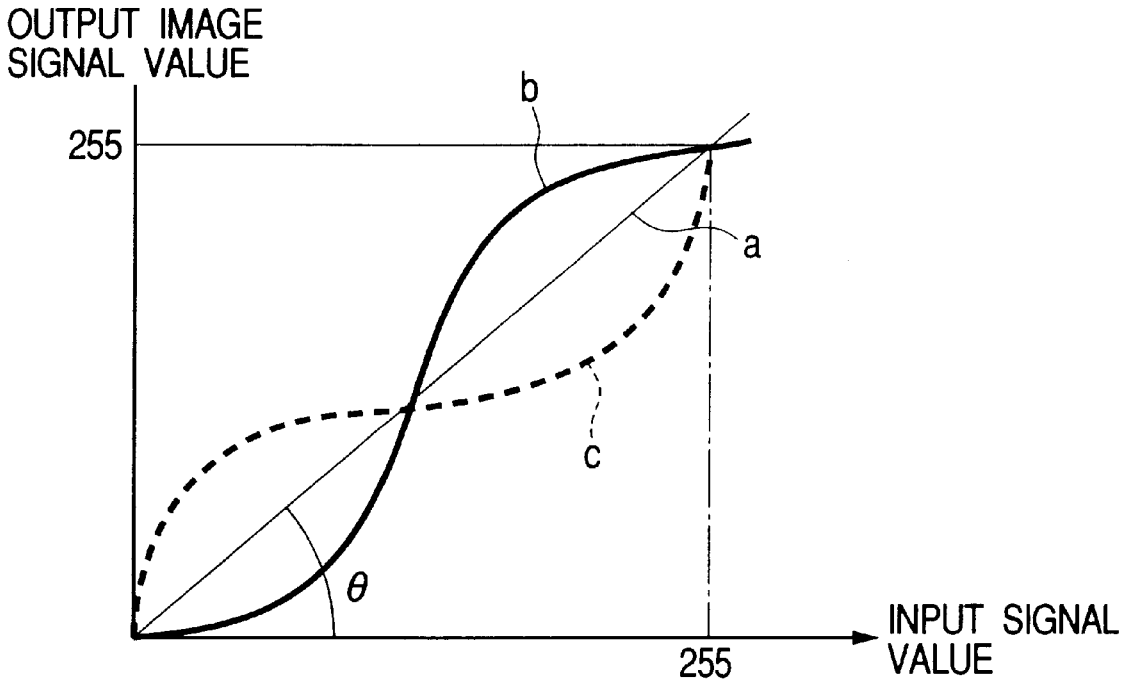
FIG. 15 is an explanatory for obtaining a correction LUT to γ correction.

When the reproduction of this proper halftone density is enabled, the relation between an input halftone density (input signal) and a halftone density (output signal) of an output image establishes the linear relation of an inclination of 45 degrees as shown in b of FIG. 15, for example. However, when the image is output in the relation between a gradation number and a halftone density, for example, the curve relation shown in b of FIG. 15 is obtained and the proper halftone density cannot be obtained. Therefore, a curve (c of FIG. 15) that becomes symmetrical to a curve (b of FIG. 15) to a straight line of an inclination of 45 degrees is previously obtained by an experiment and the difference data between this curve (c of FIG. 15) and the straight line (a of FIG. 15) is stored in the memory 25 as a correction LUT (lookup table) in gradation levels.

Figure 33:
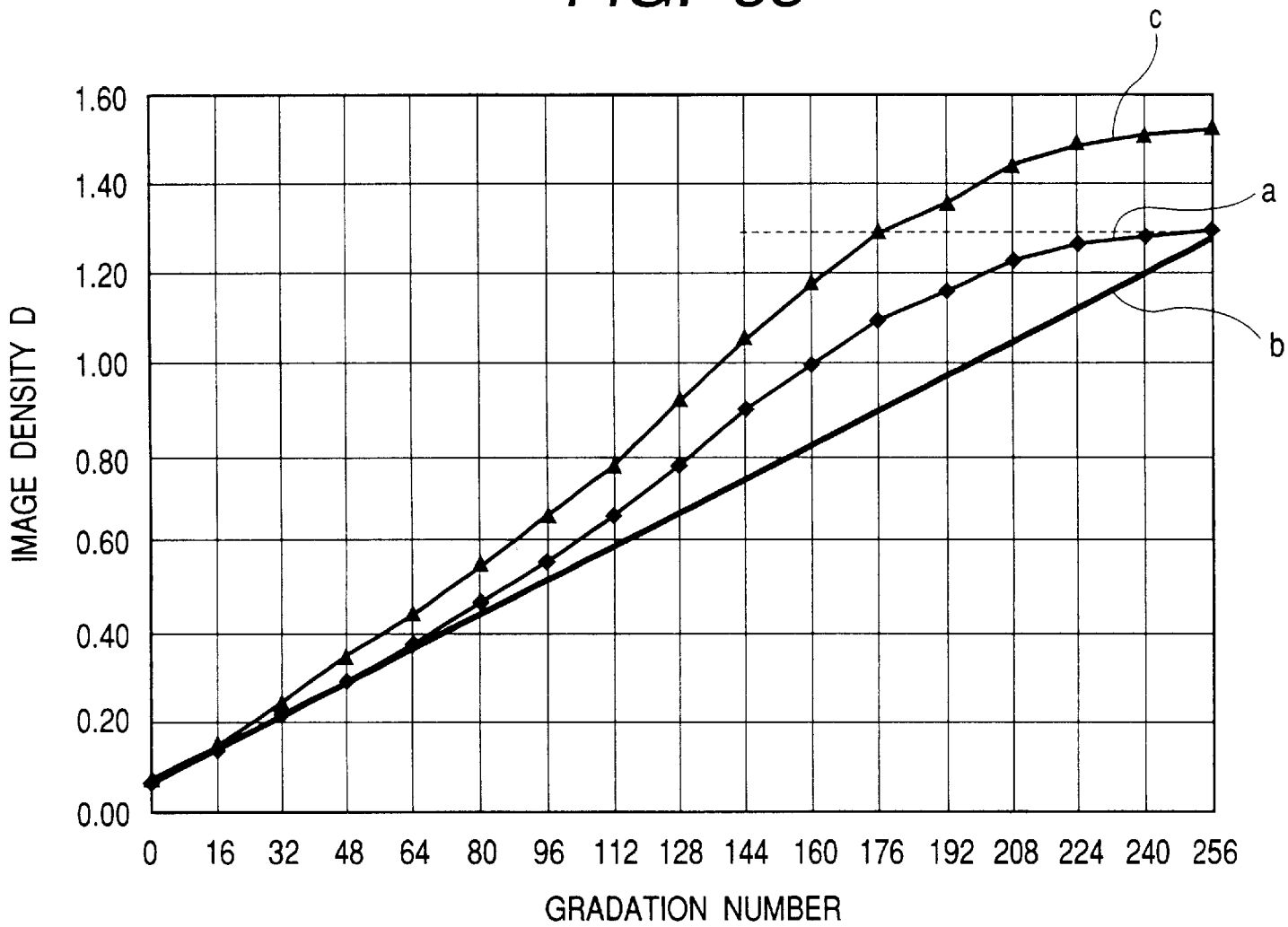
FIG. 33 is a diagram showing the relation between a gradation number and an image density.

Then when the halftone density to a gradation number shown in a of FIG. 33 does not establish a linear relation, an output image of the proper halftone shown in b of FIG. 33 can be obtained by adding the correction LUT above to an image density signal and performing Y correction. Further, since the correction LUT above differs depending on an environmental change of a developer used in the developing apparatuses 3*a* to 3*d*, an environmental change of the exposure portion potential on the photosensitive drums 1*a* to 1*d* and a latent image contrast potential condition or a development contrast potential condition for obtaining a predetermined density, the previously experimentally obtained result in accordance with each temperature and humidity environment is stored in the memory 25 as the LUT as described above, and the proper halftone density can always be reproduced by suitably selecting it in accordance with the operating environment of the image forming apparatus.

In this embodiment, the LUT in the latent image contrast potential and development contrast potential that correspond to each moisture amount (temperature and humidity environment) is previously tabulized and stored in the memory 25. The controller 17 performs gradation correction from this table information so that a proper image density and a halftone density can be obtained in accordance with each moisture amount.

Figure 16:
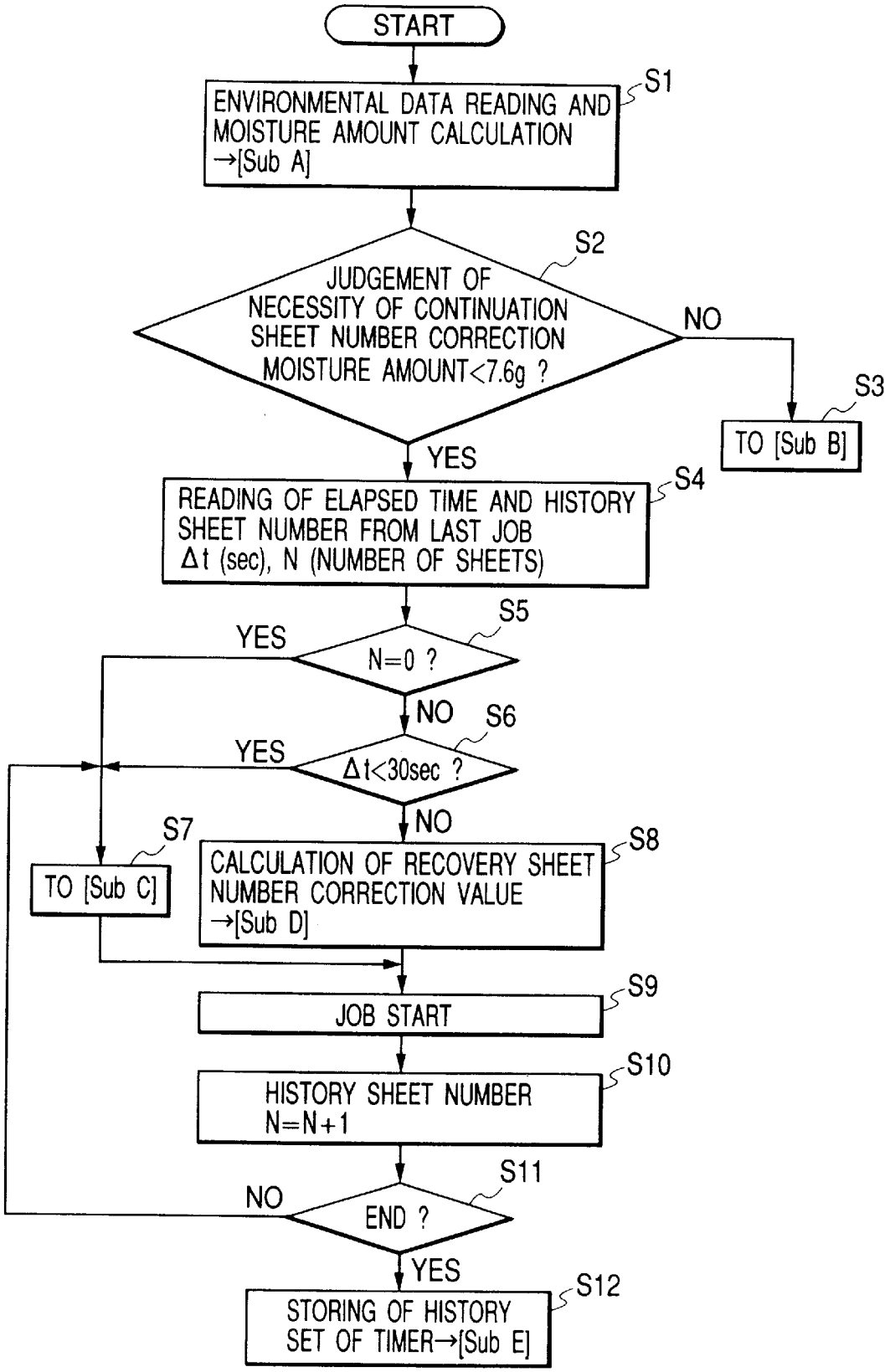
FIG. 16 is a flowchart showing the correction control of an image density according to Embodiment 4 of the present invention.

Next, the control that corrects a change of the image density or halftone density in a low humid environment in this embodiment is described referring to the flowchart shown in FIG. 16.

First, the temperature and humidity sensor 16 detects the temperature and humidity environment in an image forming apparatus, and the controller (CPU) 17 calculates a moisture amount in the air of the image forming apparatus based on the input temperature and humidity information (step S1).

Subsequently, to obtain a proper image density and a proper halftone density to this obtained moisture amount, the setting of a development contrast potential and the selection of a correction value of an LUT described below are executed.

Figure 18:
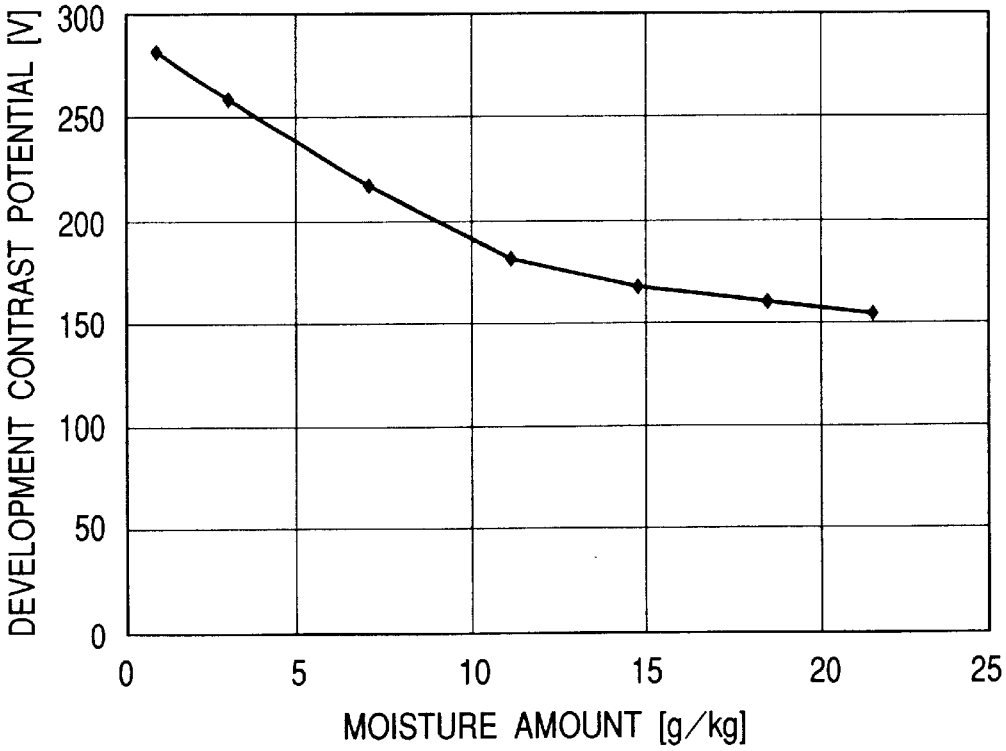
FIG. 18 is a diagram showing the relation between a moisture amount and a development contrast potential in an image forming apparatus.

The toner electrification amount Q/M and a transferring condition used for development are changed according to the temperature and humidity environment. Accordingly, a necessary development contrast potential changes in accordance with the moisture amount within an image forming apparatus (refer to FIG. 18). Further, the non-exposure portion potential Vd and the exposure portion potential Vl that are the electrification voltage of the photosensitive drums 1*a* to 1*d* change in accordance with the moisture amount described above within the image forming apparatus (see FIG. 19). The relation between the surface potential Vd and the exposure portion potential Vl in each moisture amount shown in FIG. 19 is stored in the memory 25 provided in the controller 17 in a previously tabulized state.

Figure 19:
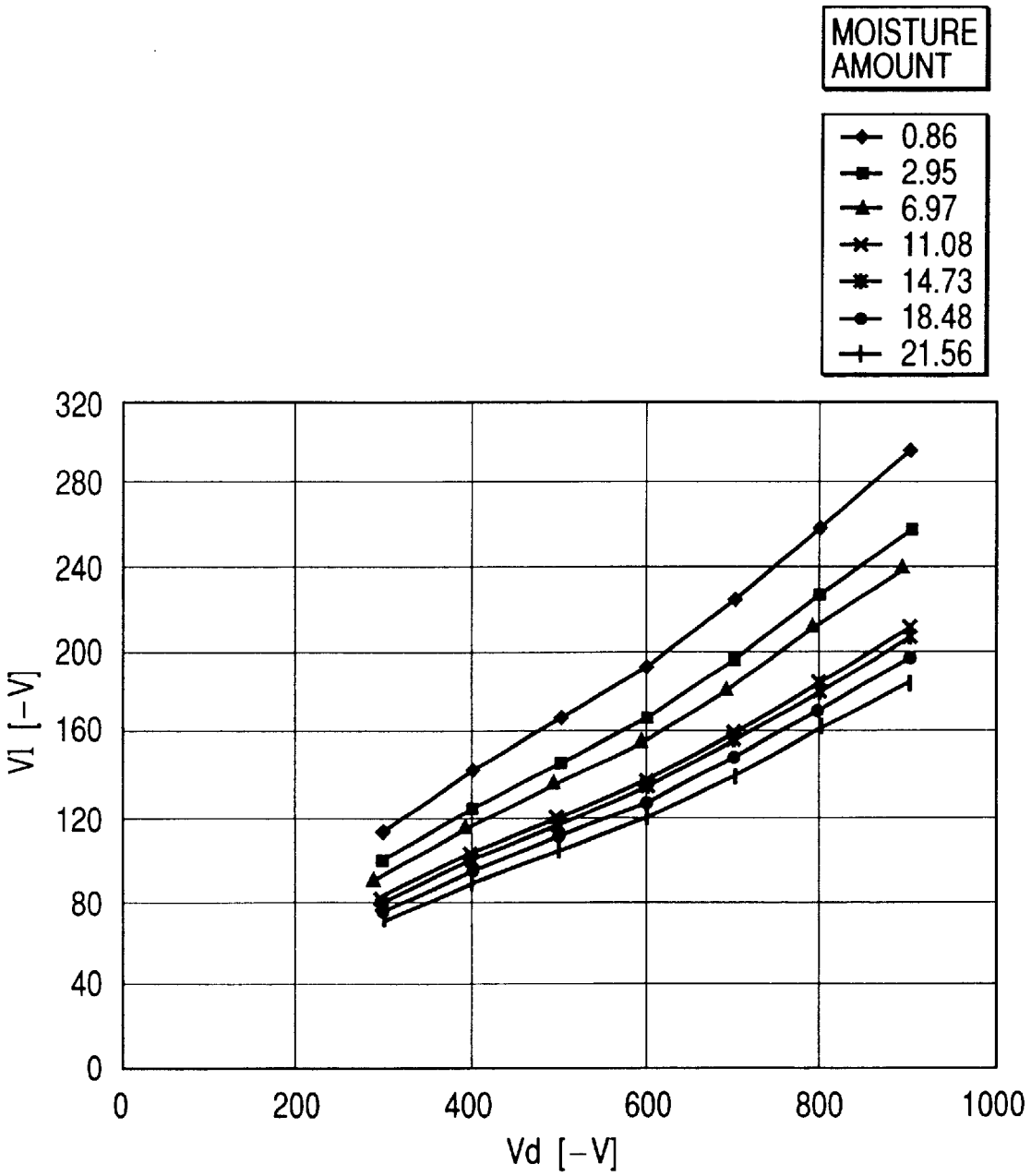
FIG. 19 is a diagram showing the relation between an exposure portion potential and a non-exposure portion potential to a moisture amount in an image forming apparatus.

Then, in this embodiment, a development contrast potential (Vcont) required in accordance with each moisture amount shown in FIG. 19 is stored in the memory 25 of the controller 17 in a previously tabulated state, and the controller 17 calculates the necessary development contrast potential from the stored information to the moisture amount in the air within an image forming apparatus calculated based on the information from the temperature and humidity sensor 16. A necessary latent image contrast potential is obtained to this necessary development contrast potential Vcont by adding a back potential (Vback) required as a dirty background measure.

Thus, to obtain the latent image contrast potential obtained above, the controller 17 calculates the non-exposure portion potential Vd and the exposure portion potential Vl of the photosensitive drums 1*a* to id from the relational table of the non-exposure portion potential Vd and the exposure portion potential Vl in each of the stored moisture amounts (see (a) of FIG. 17). A value in which this calculated exposure portion potential Vl and the development contrast potential Vcont obtained above are added is set as the developing sleeve potential Vdc.

Figure 20:
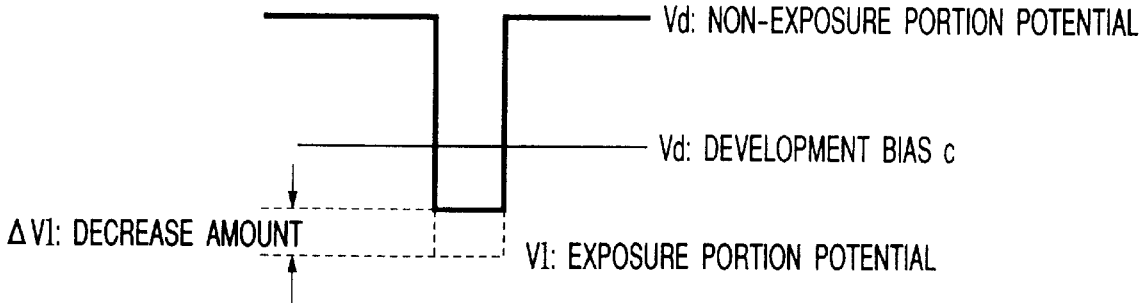
FIG. 20 is a diagram showing the relation between an exposure portion potential and a non-exposure portion potential.

Then a continuous image forming operation is executed according to the image forming conditions (the non-exposure potential Vd and the exposure portion potential Vl of the photosensitive drums 1*a* to 1*d* and the developing sleeve potential or the like). At this continuous image formation, when the inside of an image forming apparatus is in a low humid environment, as shown in FIG. 20, the exposure portion potential Vl of the photosensitive drums 1*a* to 1*d* decreases to the extent of A Vl and a development contrast potential increases. Since of the decrease of this exposure portion potential Vl, as shown in c of FIG. 33, the relation of an output image density to a gradation number (output density signal value level) changes to the direction of a density increase.

Then, in this embodiment, a size of the change of this exposure portion potential Vl, a change amount of the image density of a gradation number (output density signal value level) and a change amount of the halftone density are previously obtained experimentally, and an LUT correction value required for this change correction is stored in the memory 25, then the correction information of an LUT in a low humid environment is fed back to the controller 17. When it is judged that gradation correction is necessary, the history number of sheets (image forming number of sheets) N described below and correction values of an image density and a halftone density are determined according to the time (interval) At conditions of the preceding image forming operation and the next image forming operation (step S2).

Figure 7:
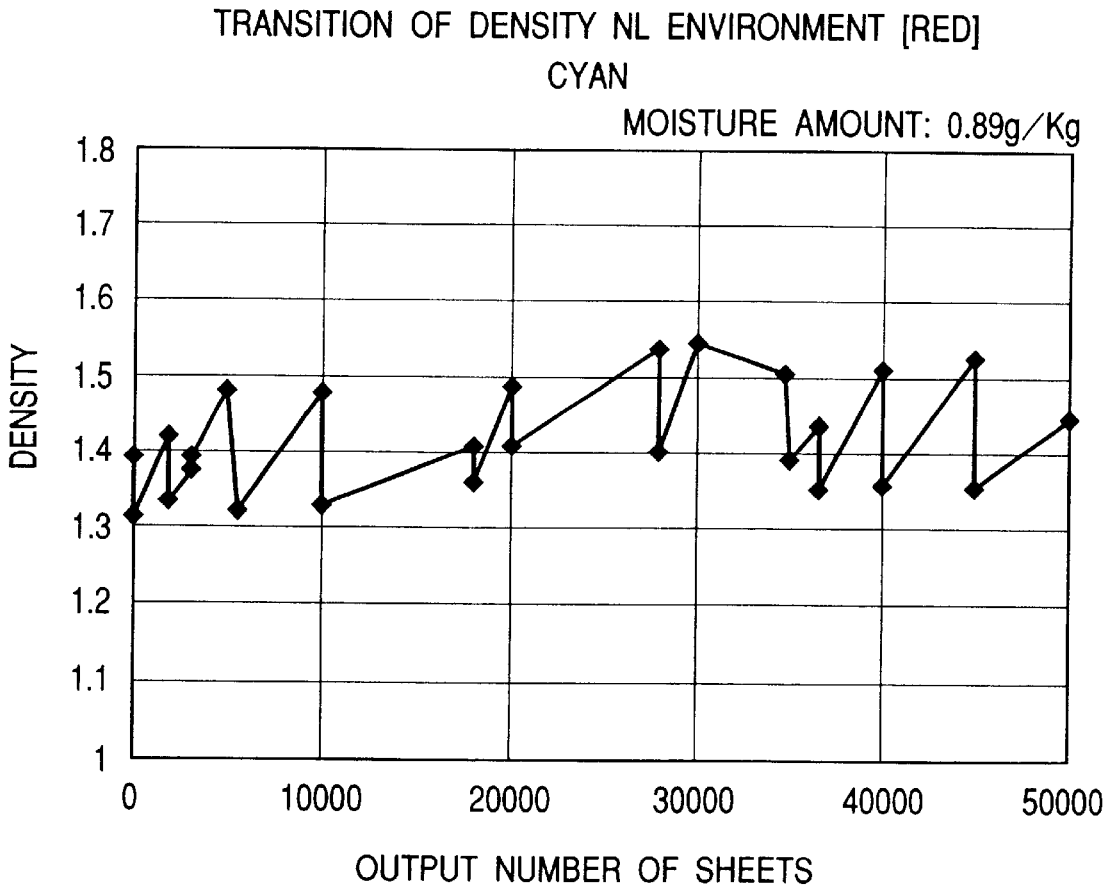
FIG. 7 is an explanatory drawing showing a transition of a Dmax density at the time when a continuous image output was performed in a low humid environment at a temperature of 23° C. and a humidity of 5%.

The environment in which gradation correction is performed at the change of exposure portion potential Vl is a low humid environment in which a moisture amount is 7.6 (g/kg) or less as shown in FIG. 7, and in the environment in which the moisture amount exists, an image is output in the normal image forming operation in the step S3 ((b) of FIG. 17). Besides, in the step S3 ((b) of FIG. 17), since this case indicates the start of an image forming operation, the history number of sheets (image forming number of sheets) N is 0 and the correction value X of an LUT is 0.

Then, in step S2, if it is judged in the controller 17 that the moisture amount within an image forming apparatus is 7.6 (g/kg) or less based on the temperature and humidity information from the temperature and humidity sensor 16, the controller 17 judges a continuous state of an image forming operation (step S4).

In this embodiment, if the next image forming operation start signal is issued within 30 seconds from the end of a series of image forming operations, judgment that it is assumed to be a continuous state successively is performed. Besides, the time Δt when this continuous state is judged (30 seconds for this embodiment) can arbitrarily be set. Further, at this time, the history number of sheets (image forming number of sheets) N from the time of the preceding image forming operation is continuously measured and counted by the sheet number measuring counter 19 and this measurement information is input to the controller 17.

Further, the measurement of the time Δt is performed by the measuring apparatus 20. As the timing used for the time measurement from the end of the preceding image forming operation, the stop timing in the drive portion inside an image forming apparatus, for example, any stop timing of the photosensitive drums 1*a* to 1*d*, the developing apparatuses 3*a* to 3*d*, the fixing apparatus 13 and sheet feed conveying systems of the transferring material P. Further, instead of these drive systems, the measurement can be carried out by the utilization of each control timing of the application of each bias at the time of the image formation, a heat source for the fixing apparatus 13, or cooling in the apparatus by fans 15*a*, 15*b*, 15*c*. In the measurement apparatus 20 of this embodiment, time measurement was performed using the operation of a sheet feed actuator (not shown) as a trigger.

Further, in this embodiment, if the time (interval) Δt of the preceding image forming operation and the next image forming operation is ten minutes or more, a non-continuous state is assumed and the potential decrease of the photosensitive drums 1*a* to 1*d* is assumed to have completely been recovered. This recovery time is also a value which changes according to the physical property conditions, image forming conditions or the like of the photosensitive drums 1*a* to 1*d* used, and it is an arbitrarily decidable condition. Then, when this non-continuous state occurs, the history of measurement number of sheets judged to be continuous and the correction value of an LUT are also reset to 0.

Further, in this embodiment, when the time (interval) Δt of the preceding image forming operation and the next image forming operation is 30 sec<Δt<10 min, an elapsed time is converted to the measurement number of sheets and the result is subtracted from the number of sheets stored as the history of the preceding image forming operation. Gradation correction is performed based on the correction value of an LUT that conforms to the subtracted measurement number of sheets and the corrected measurement number of sheets (recovery number of sheets). Then an example of the method for obtaining the recovery number of sheets is described below.

If the output number of sheets (N) required until a decrease amount of the potential of the photosensitive drums 1*a* to 1*d* is saturated: N=1,000 sheets (experimental value), the time (T) required until a decrease amount of the potential of the photosensitive drums 1*a* to 1*d* is recovered: T=10 minutes (experimental value), and the production speed (CV) of an image forming apparatus: CV=20 cpm (copy/min) (design value), when the time (interval) of the preceding image forming operation and the next image forming operation is Δt, the following formula is obtained.

$$\text{Recovery number of sheets } S=(\Delta t\times CV\times A)/60 \qquad \text{Formula (1)}$$

Where, a correction coefficient A is A=N/(CV×T)=1,000/(20×10)=5

By this calculation, the recovery number of sheets S that corresponds to a production speed of an output image of the image forming apparatus can be defined.

Subsequently, in step S4, every time an image forming operation start signal is issued and an image forming operation is performed, the history number of sheets (image forming number of sheets) N and the time (interval) At of the preceding image forming operation and the next image forming operation are read by the controller 17 as described above (steps S5, S6). Then in steps S5, S6, when the history number of sheets (image forming number of sheets) N=0 and Δt<30 (sec), a continuous image forming operation is assumed and the processing in step 7((c) of FIG. 17) is performed. In the step S7 ((c) of FIG. 17), the controller 17 calculates a correction value of an LUT from the table of a previously stored correction value and the history number of sheets (image forming number of sheets), and the controller 17 inputs the correction value information of this LUT and performs gradation so that a proper image density and a halftone density can be obtained.

Further, in steps S5, S6, when the history number of sheets (image forming number of sheets) N is not 0 but Δt>30 (sec), the processing of step S8 ((d) of FIG. 17) is performed. In step S8 ((d) of FIG. 17), as described above, when Δt is ten minutes or more, a non-continuous state is assumed and the controller 17 performs gradation control using a predetermined set value decided based on the temperature and humidity information and image forming conditions at this time. Further, as described above, when Δt is 30 sec<Δt<10 min, an elapsed time is converted to the measured number of sheets and the result is subtracted from the number of sheets stored as the history of the preceding image forming operation. A correction value of an LUT that conforms to the subtracted measurement number of sheets and the corrected measurement number of sheets (recovery number of sheets) is calculated.

The recovery number of sheets S can be obtained according to Formula (1), and the corrected history number of sheets N (N=N−S) is obtained by subtracting the recovery number of sheets N from the history number of sheets from the preceding image forming operation. Further, when the corrected history number of sheets N is N<0 obtained, N=0 is set and processing returns to step S5.

Then a gradation correction value obtained in steps S7 and S8 is assigned and a JOB (job) that is the next image forming operation is started (step S9), then the history number of sheets is updated (N=N+1) by adding 1 to the history number of sheets (step S10). Subsequently, after this image forming operation (JOB), the end of an image forming operation is judged (step S11) and processing returns to the step S7 to the next image forming operation.

Further, when it is judged that an image operation is terminated in step S11, the history number of sheets at this end is stored in the memory 25. After Δt described above is reset to 0, the measurement of Δt to the next image output is started by the measuring apparatus 20 (step S12 ((e) of FIG. 17)). Furthermore, in (step S12 ((e) of FIG. 17)), when ten minutes or more elapsed from the measurement start of Δt, the history number of sheets N is reset to 0 and processing enters the wait state. Besides, at standby, too, Δt is measured. Moreover, at this standby, if an image forming operation start signal is issued, the image forming operation is started.

Furthermore, in this embodiment, when the history number of sheets N is 1,000 sheets or more, a decrease amount of the potential of the photosensitive drums 1*a* to 1*d* and an image forming operation stops, the recovery number of sheets S is counted assuming the 1,000th sheet as a datum point.

Next, the calculation of a correction value of an LUT that corresponds to a count number of this recovery number of sheets S is described.

Figure 21:
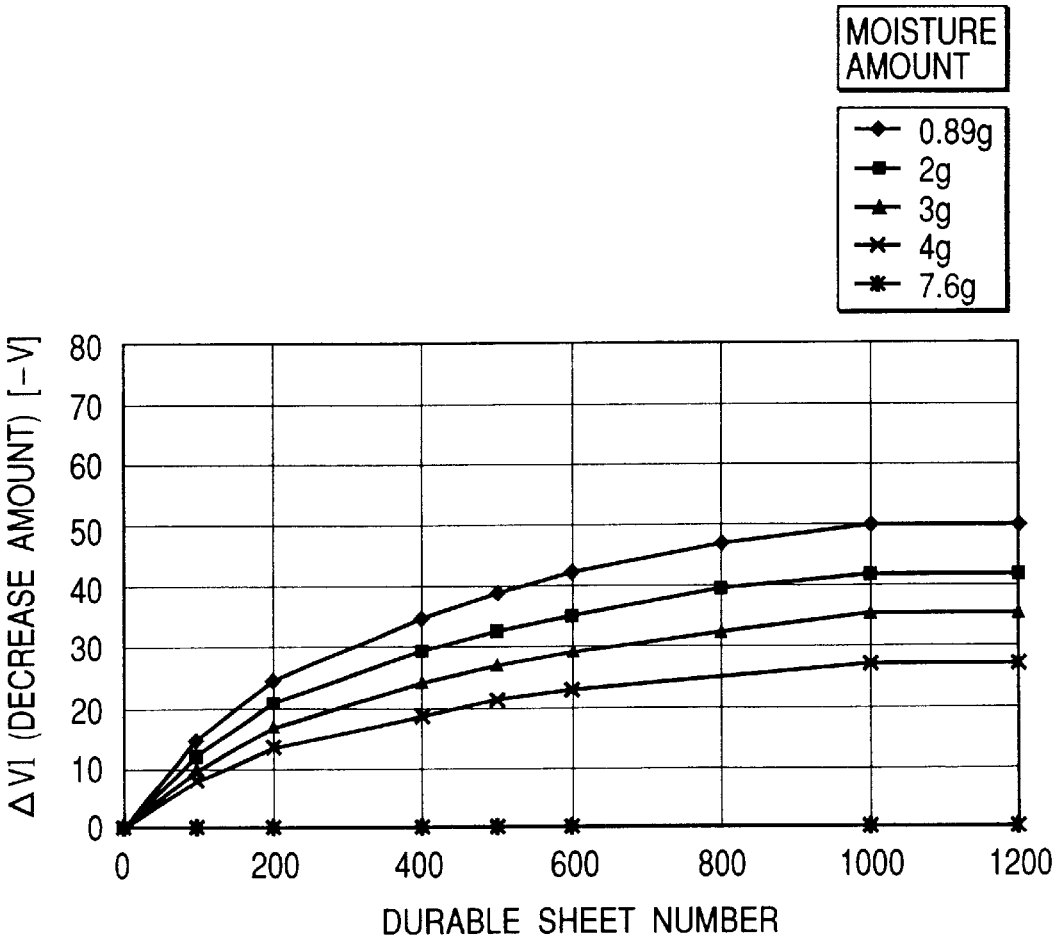
FIG. 21 is a diagram showing the relation between a durable sheet number and a decrease amount of an exposure portion potential.
Figure 22:
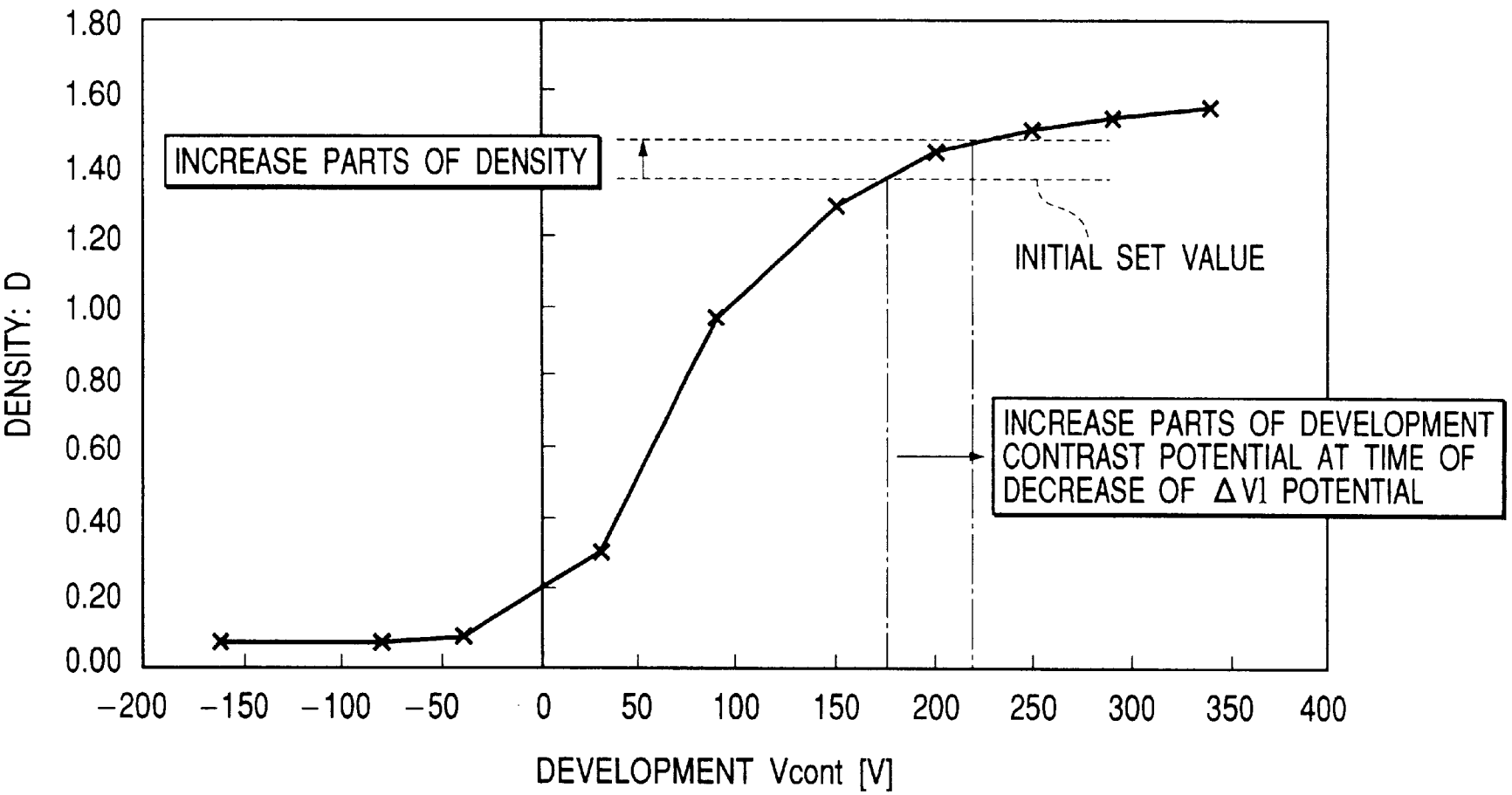
FIG. 22 is a diagram showing the relation between a development contrast potential and density.

When the relation between the continuous image forming number of sheets (durable sheet number) and a decrease amount (ΔVl) of the exposure portion potential Vl was examined, the result shown in FIG. 21 was obtained. Further, when the relation between a development contrast density and an image density in a low humid environment in which a moisture amount is small was examined, the result shown in FIG. 21 was obtained. Besides, FIG. 22 shows a condition under which the environment is at a temperature of 23° C. and at a humidity of 5% and a moisture amount is 0.89 (g/kg). As clear from the result of FIG. 22, the development contrast potential increases since of the decrease of the exposure portion potential Vl, and, accordingly, density also increases from an initial set value to the extent of a predetermined value.

Figure 23:
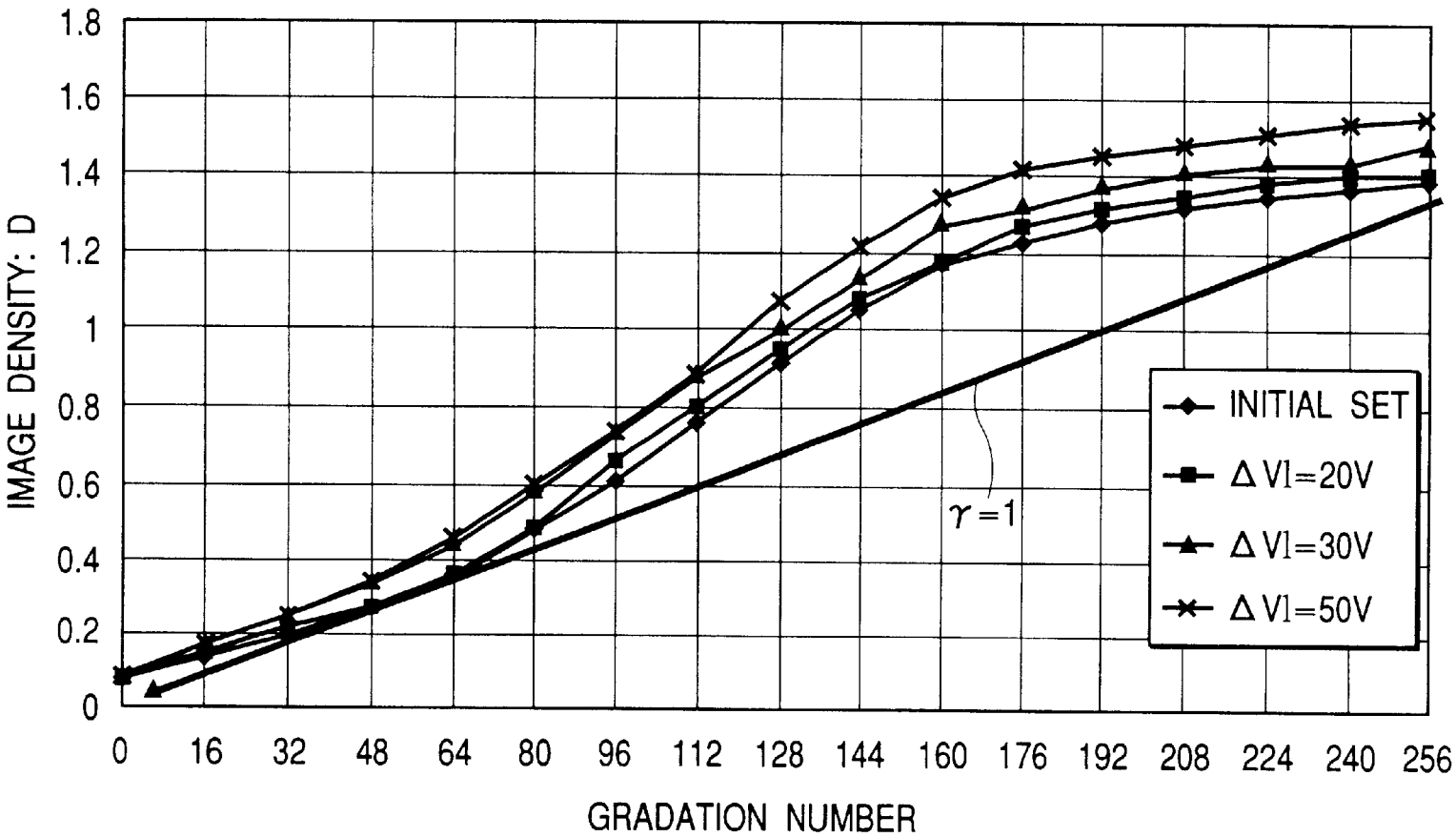
FIG. 23 is a diagram showing the relation between a gradation number and an image density.

Further, when the development contrast potential decreases from a proper value (in the diagram, ΔVl is 20, 30 and 50 V), the relation between a value of the image density and halftone density to an image signal level (gradation number) is examined, and the result shown in FIG. 23 was obtained. In the result of the experiment of FIG. 22, in the initial state before continuous image formation, γ correction is performed to an image signal level (gradation number) so that γ=1 can be obtained. However, since the γstate changes by continuous image formation, an LUT change value of the γ correction needs to be obtained so that it can correspond to this γchange. Hence, in this embodiment, the relation of a correction value of an LUT at continuous image forming number of sheets (continuation number of passed sheets) obtained from the experiments shown in FIG. 21 to FIG. 23 is previously stored in the memory 25 as a measurement value at an arbitrary point when a moisture amount is 7.6 (g/kg) or less.

Subsequently, the controller 17 can obtain a good image free of a density change by assigning the necessary LUT correction value that conforms to the operating environment of an image forming apparatus and controlling density based on the data stored in the memory 25. Besides, the correction control of a density change in this case is also performed as described in FIG. 33 and FIG. 15.

Thus, in this embodiment, a good image free of a density change by assigning the necessary LUT correction value that conforms to the operating environment of an image forming apparatus and controlling density.

(Embodiment 5)

In Embodiment 4, necessary γ correction is performed to a potential change of the exposure portion potential Vl that occurs at the continuous image formation in a low humid environment and an image density and a halftone density are corrected. However, in this embodiment, after a latent image contrast potential and a development contrast potential were corrected, an attempt was made to correct the necessary γ correction. This embodiment is described below. This embodiment is also described using the image forming apparatus of Embodiment 4 shown in FIGS. 12 to 14.

If the exposure portion potential Vl decreases at continuous image formation, a latent contrast potential and a development contrast potential change as shown in FIG. 20. At this time, the relation between the non-exposure portion potential Vd and the exposure portion potential Vl changes from the position of a solid line (a) to a dotted line (b), for example, in a low humid environment in which a moisture amount is 0.86 (g/kg).

When the toner states on the developing sleeves of the developing apparatuses 3*a* to 3*d* are not changed, since a value of an image density follows a development sensitivity curve as shown in FIG. 22, the development contrast potential for obtaining a proper image density can be considered identical even if a potential change of the exposure portion potential Vl occurs. Further, when the back potential Vback is kept constant, the latent image contrast potential is also kept constant.

Figure 25:
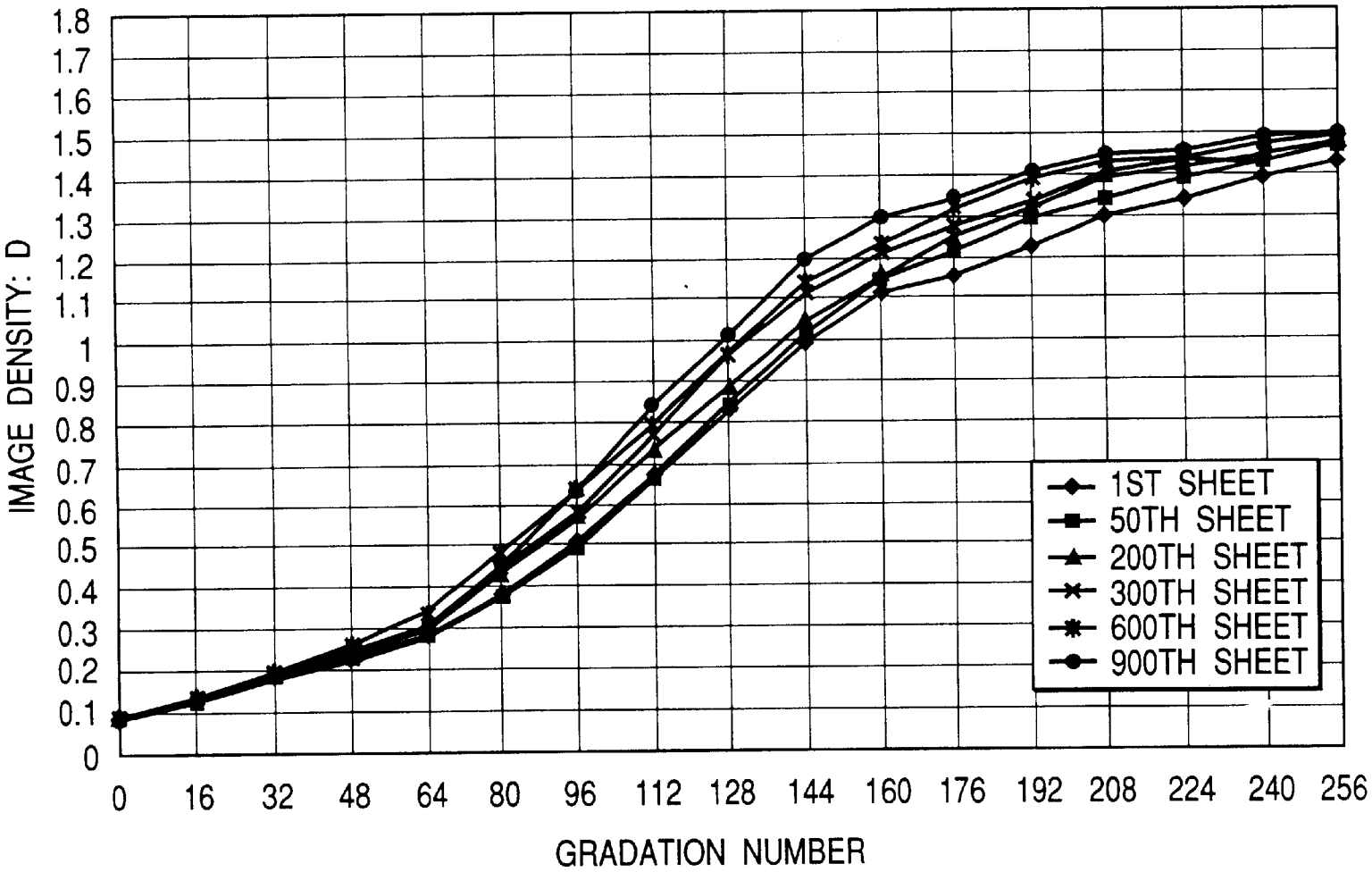
FIG. 25 is a diagram showing the relation between a gradation number and an image density according to Embodiment 5 of the present invention.

However, when continuous image formation is performed in a low humid environment, the E-V character (relation between an exposure amount and the exposure portion potential) of the photosensitive drums 1*a*, 1*b* change. Further, since the values of the non-exposure portion potential and the exposure portion potential of the photosensitive drums 1*a*, 1*b* were changed due to the correction of the latent image contrast potential and the development contrast potential, a halftone density changes as shown in FIG. 25. This situation is further described in detail using FIG. 26.

Figure 26:
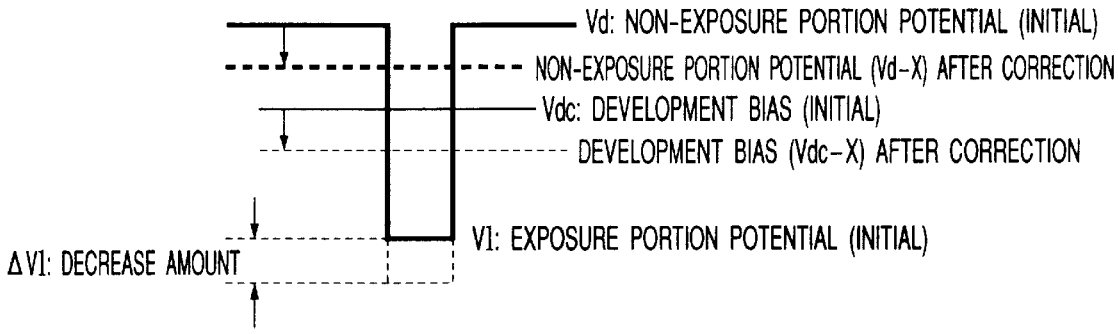
FIG. 26 is a diagram for explaining the relation between a non-exposure portion potential and a development bias at the time when an exposure portion potential decreased.

The set value of the exposure portion potential Vl in an initial state shown in FIG. 26 is the potential of an image forming condition decided by the control of Embodiment 4. Further, a necessary development contrast potential in an arbitrary environment is obtained from a moisture amount based on the result of FIG. 18 as described in Embodiment 4. A necessary latent image contrast potential is decided by adding a necessary back potential to this development contrast potential.

As an example of the case where a latent image contrast potential and a development contrast potential were performed, it is assumed that the potential setting condition on the photosensitive drums 1*a*, 1*b* is −700 V for the non-exposure portion potential Vd and −224 V for the exposure portion potential Vl, a decrease amount of the exposure potential Vl is −50 V and the exposure portion potential Vl decreases to the extent of about 22% from −224 V. At this time, the latent image contrast potential Vcont changes to a relational straight line of Vd to Vcont that decreased by 22% from an initial setting.

Figure 24:
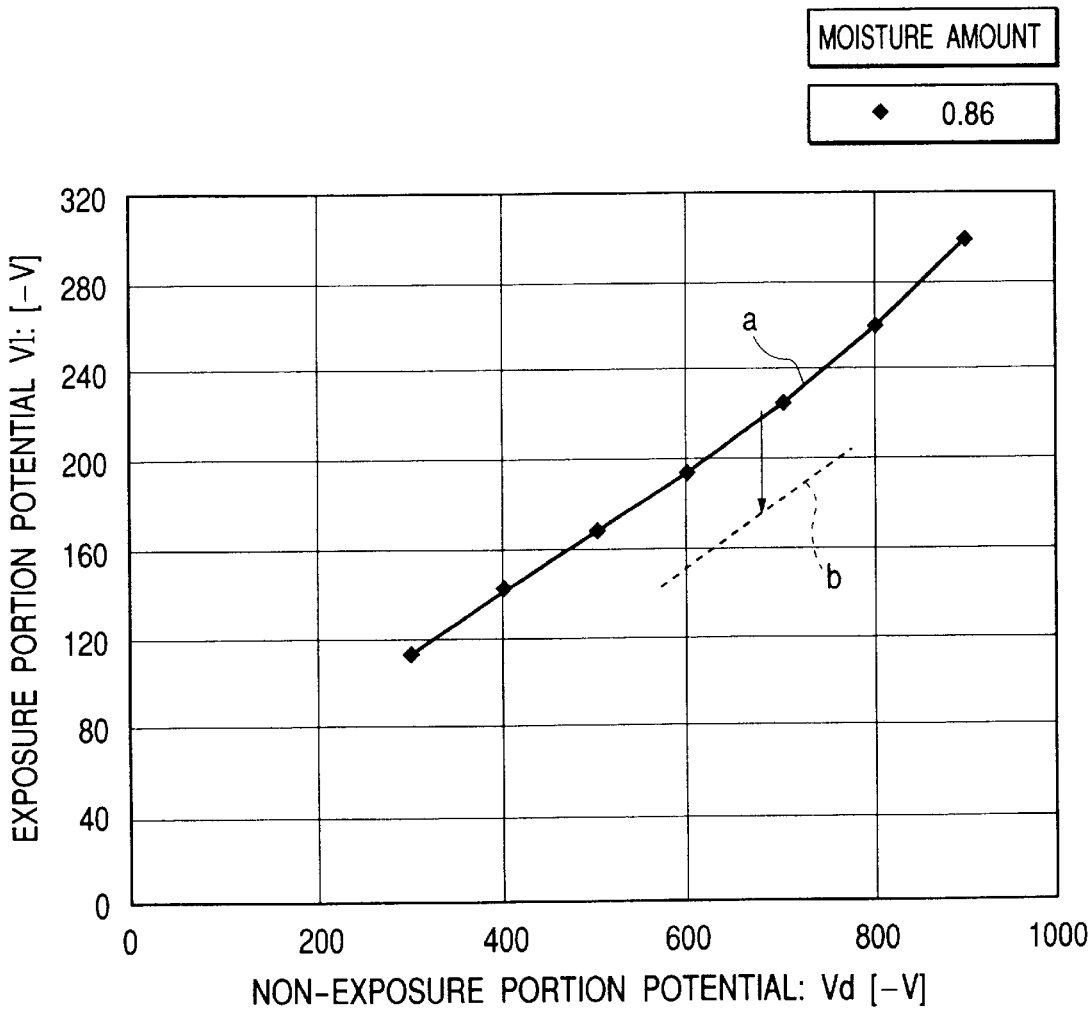
FIG. 24 is a diagram showing the relation between a non-exposure portion potential and an exposure portion potential.

Further, even if the exposure portion potential Vl changes, since the latent image contrast potential and the development contrast potential required for the same density value are fixed, the latent image contrast potential of an initial state is also kept constant from the experimental data of FIG. 24 so long as the development sensitivity curve shown in FIG. 22 is kept constant.

Figure 27:
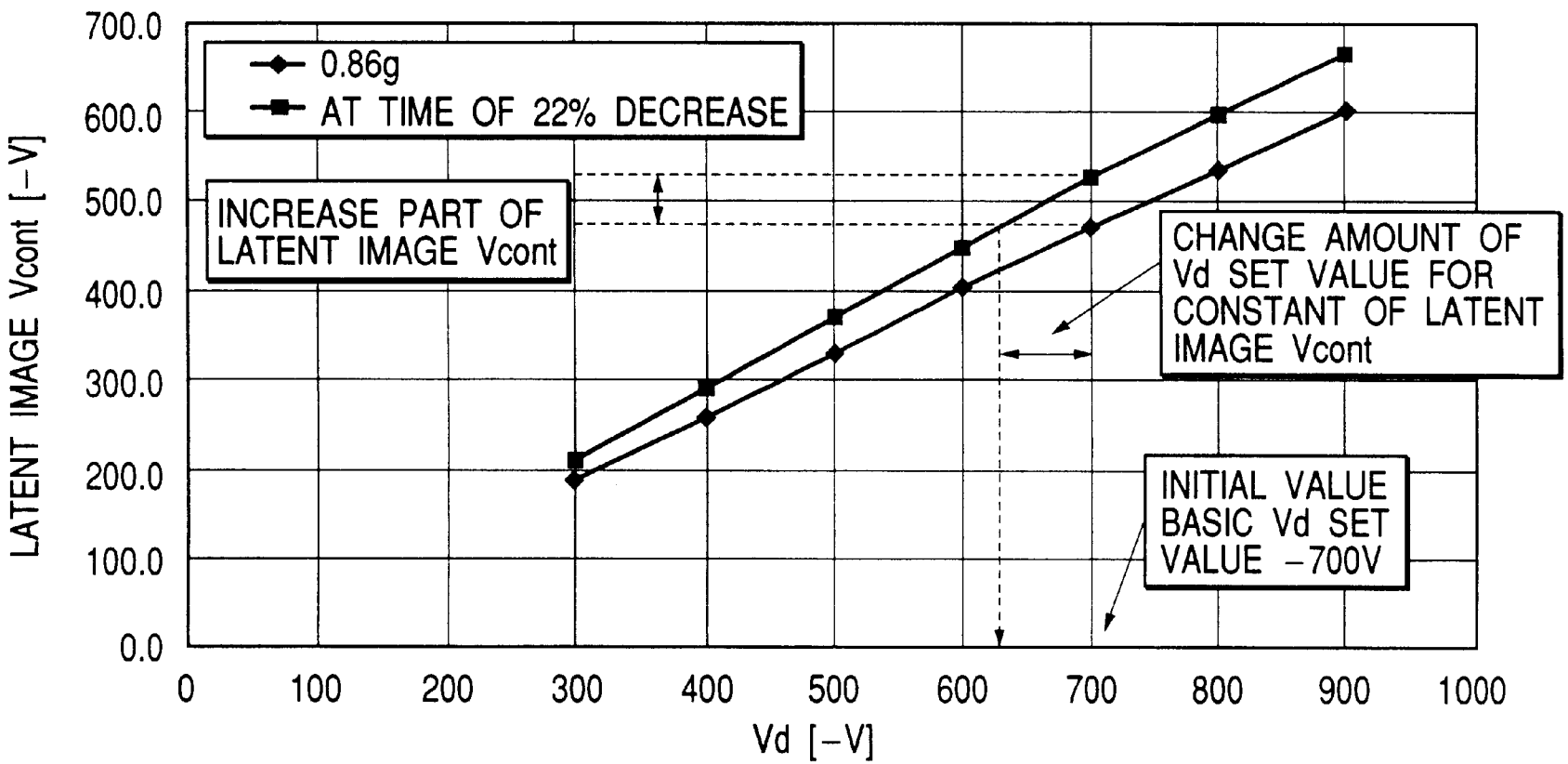
FIG. 27 is a diagram showing the relation between a non-exposure portion potential and a latent image contrast potential at the time when an exposure portion potential decreased.

Accordingly, a set value of a non-exposure portion potential vd' from which the same potential difference as at initial time is obtained from the latent image contrast potential when the non-exposure portion potential Vd and the exposure portion potential Vl of the photosensitive drums 1*a*, 1*b* shown in FIG. 27 decrease. At this case, after the initial non-exposure portion potential Vd—changes, a Vd'= correction value X (V) of the non-exposure portion is obtained. Further, if the back potential is kept constant, the development bias potential can be obtained by reducing this correction value X only.

Figure 28:
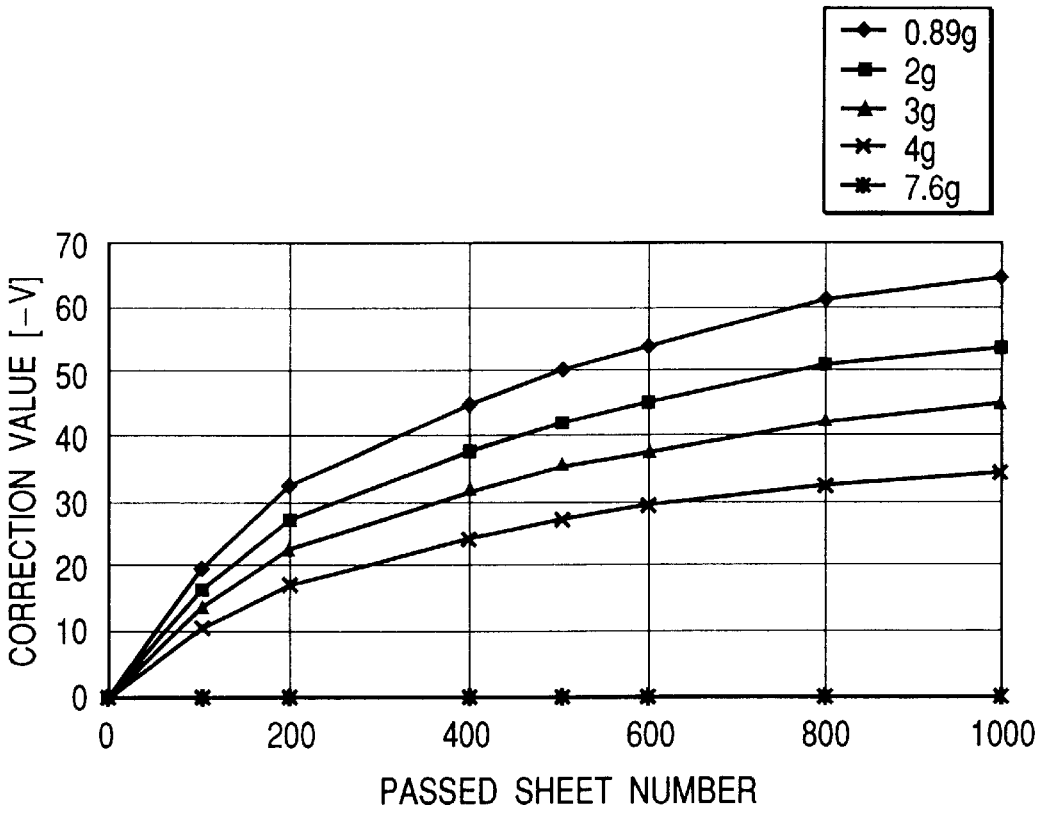
FIG. 28 is a diagram showing the relation between a passed sheet number and a correction value of a non-exposure portion potential or a development bias potential.

The procedure is performed, and using FIG. 19, FIG. 21 and FIG. 22 in which the relation of the potential decrease amount that conforms to the continuation image forming number of sheets in a low humid environment, a value of the actually necessary correction value X is obtained from the result of an experiment. The relation of the continuation image forming number of sheets (number of passed sheets) and a correction value in a low humid environment as shown in FIG. 28 is tabulized and stored in the memory 25. Subsequently, using this table data, a correction value X calculated in accordance with an increase of the continuous image forming number of sheets in a low humid environment and a latent image contrast potential and a development contrast potential are corrected in accordance with this correction value X. This correction value X is calculated in accordance with the continuous image forming number of sheets and a moisture amount and output to [SubA] in the step S1 of FIG. 16.

Further, in this embodiment, too, the number of sheets measurement that judges the continuation of image formation is performed in the same manner of Embodiment 4. That is, step S7 of a flowchart shown in FIG. 16 changes to the sequence shown in FIG. 29. In this sequence, a correction value X is calculated based on the table data of a correction value and the continuation image forming number of sheets (number of passed sheets) as described above.

Figure 30:
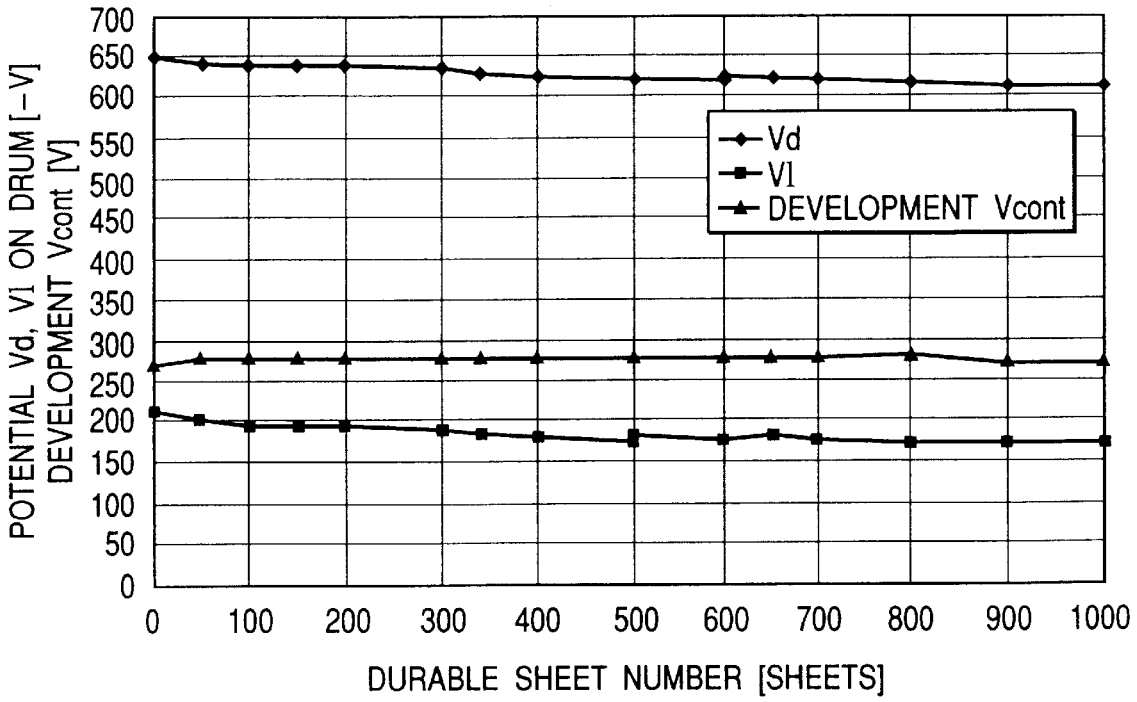
FIG. 30 is a diagram showing the relation between a durable sheet number and potential on a photosensitive drum at the time when the correction sequence of the latent image contrast potential or the development contrast potential was performed according to Embodiment 5 of the present invention.

During continuous image formation in a low humid environment, by performing the correction of a latent image contrast potential and a development contrast potential as described above, as shown in FIG. 30, values of the non-exposure portion potential Vd and the exposure portion potential Vl are changed and the development contrast potential Vcont is almost kept constant.

Next, the correction of a halftone density to each image signal level (gradation number) is described at the time when the correction of the latent image contrast potential and development contrast potential is performed as described above.

Figure 31:
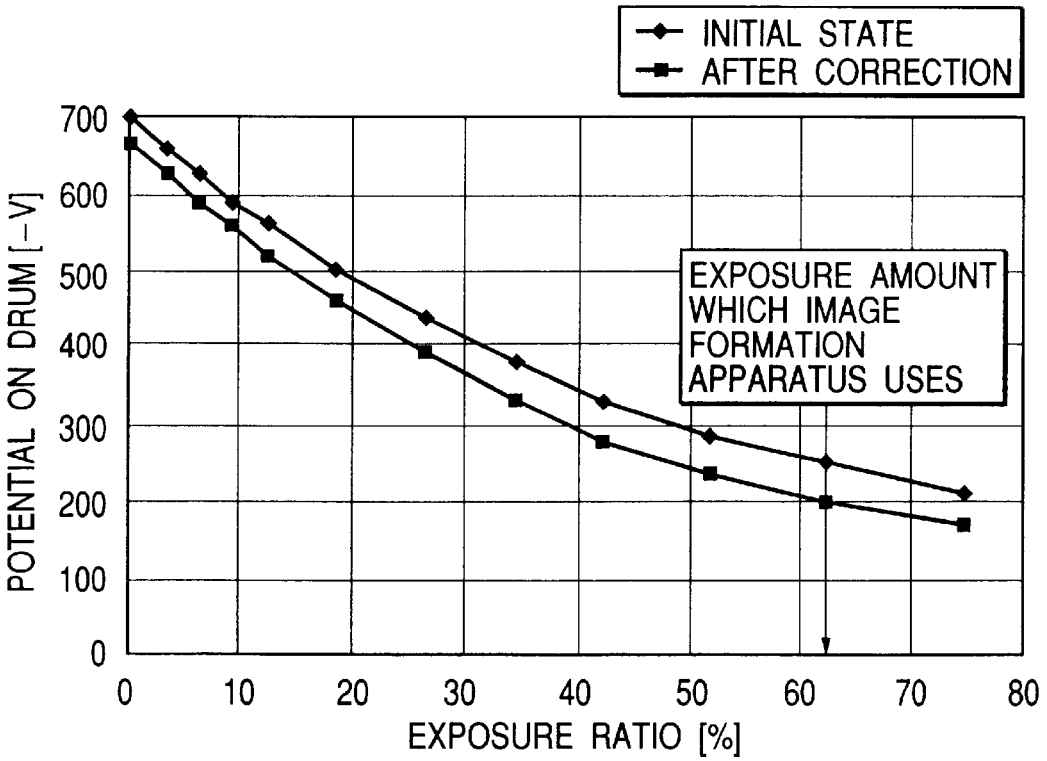
FIG. 31 is a diagram showing the relation between an exposure ratio (exposure amount) and potential on a photosensitive drum.

In Embodiment 4, when a density value becomes larger than an initial state, the correction of only an LUT was performed. However, under the condition of this embodiment, since the LUT is corrected so that the development contrast potential can be kept constant, there is no change of the density value. However, since both values of the non-exposure portion potential Vd and the exposure portion Vl were changed when the correction of the development contrast potential was executed, image formation is performed under the condition where the E-V character of the photosensitive drums 1*a*, 1*b* used differs as shown in FIG. 31. At this time, although the halftone density to each image signal level (gradation number) does not change for the density value in which the image signal value (gradation number) is in 255 levels, a density change in a halftone image signal level (gradation number) occurs.

Therefore, in this embodiment, a halftone density change can be suppressed by storing a change amount of the halftone density (refer to FIG. 25) that occurs by the correction of a latent image contrast potential and a development contrast potential in the memory 25 as the table data that conforms to the correction value X and performing the correction of the latent image contrast potential and the development contrast potential as described above. At the same time, the halftone density change can be suppressed by assigning a correction value of an LUT in the same manner as Embodiment 4 and performing density control.

Besides, in a control flow during this continuous image formation changes step S7 of the flowchart shown in FIG. 16 to the sequence shown in FIG. 29 and also changes step S8 to the sequence shown in FIG. 32. This correction value X is calculated in accordance with the continuation image forming number of sheets and a moisture amount. Subsequently, this correction value X becomes a γ-corrected LUT change amount and output to [SubA] in step S1 of FIG. 16.

As described above, according to the present invention, even the exposure portion potential decreases at the time when continuous image formation is performed in a low humid environment, a good image free of a change of an image density and a change of a halftone density can be obtained by obtaining a correction value in accordance with the change of the image density and the change of the halftone density, adding this correction value and performing density control.

Although the embodiments of the present invention were described above, it is to be understood that the present invention is not limited to these embodiments and enables every modifications in a technical idea.

What is claimed is:

1. An image forming apparatus, comprising:

an image bearing member for bearing an electrostatic image;

developing means for developing the electrostatic image on said image bearing member;

temperature and humidity detecting means for detecting temperature and humidity;

deciding means for deciding an image forming condition based on the detection output of said temperature and humidity detection means; and correcting means for correcting the decision of the image forming condition by said deciding means in a low humid environment and at continuous image formation.

2. The image forming apparatus according to claim 1, wherein said deciding means calculates an absolute moisture amount from the detection output of said temperature and humidity detection means, and changes the image forming condition based on this calculated absolute moisture amount.

3. The image forming apparatus according to claim 1, wherein said deciding means decides a contrast potential of the electrostatic image.

4. The image forming apparatus according to claim 1, wherein said deciding means decides a development contrast potential by the developing means.

5. The image forming apparatus according to claim 1, wherein the correction by said correcting means is carried out only when a recording medium is paper.

6. The image forming apparatus according to claim 1, which has a timer for measuring a time between two continuous image outputs, and when the measured time is within a predetermined time, continuous image formation is recognized.

* * * * *

UNITED STATES PATENT AND TRADEMARK OFFICE

CERTIFICATE OF CORRECTION

PATENT NO. : 6,463,226 B2
DATED : October 8, 2002
INVENTOR(S) : Kenichiro Kitajima et al.

It is certified that error appears in the above-identified patent and that said Letters Patent is hereby corrected as shown below:

Column 2,
Line 59, “VI” should read -- V1 --.

Column 3,
Line 27, “VI” should read -- V1 --.

Column 7,
Line 64, “stores” should read -- store --.

Column 9,
Line 5, “execution” (first occurrence) should be deleted.

Column 10,
Line 44, “At” should read -- Δt --.

Column 13,
Line 42, “every” should read -- for each of the --.

Column 14,
Line 61, “performs” should read -- perform --.

Column 17,
Line 50, “A V1” should read -- Δ V1 --.

Column 18,
Line 1, “At” should read -- Δt --.

UNITED STATES PATENT AND TRADEMARK OFFICE

CERTIFICATE OF CORRECTION

PATENT NO. : 6,463,226 B2
DATED : October 8, 2002
INVENTOR(S) : Kenichiro Kitajima et al.

It is certified that error appears in the above-identified patent and that said Letters Patent is hereby corrected as shown below:

Column 19,
Line 23, "At" should read -- Δt --.

Signed and Sealed this

Eleventh Day of November, 2003

JAMES E. ROGAN
*Director of the United States Patent and Trademark Office*